US008768210B2

(12) United States Patent
Hoashi

(10) Patent No.: US 8,768,210 B2
(45) Date of Patent: Jul. 1, 2014

(54) COLOR ELECTROPHOTOGRAPHIC IMAGE FORMING APPARATUS

(75) Inventor: Shigeru Hoashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 13/145,713

(22) PCT Filed: Mar. 16, 2010

(86) PCT No.: PCT/JP2010/054901

§ 371 (c)(1),
(2), (4) Date: Jul. 21, 2011

(87) PCT Pub. No.: WO2010/107123

PCT Pub. Date: Sep. 23, 2010

(65) Prior Publication Data

US 2011/0293324 A1 Dec. 1, 2011

(30) Foreign Application Priority Data

Mar. 19, 2009 (JP) ..... 2009-067339
Jan. 29, 2010 (JP) ..... 2010-017585

(51) Int. Cl.
*G03G 21/16* (2006.01)
*G03G 15/06* (2006.01)
*G03G 21/18* (2006.01)

(52) U.S. Cl.
CPC ..... *G03G 21/1633* (2013.01); *G03G 21/1842* (2013.01); *G03G 21/1853* (2013.01); *G03G 2221/1684* (2013.01)
USPC ..... 399/112; 399/110; 399/111; 399/114

(58) Field of Classification Search
USPC ..... 399/107, 110, 113, 114, 124
See application file for complete search history.

(56) References Cited

U.S. PATENT DOCUMENTS 6,078,765 A 6/2000 Takano et al.
6,708,011 B2 * 3/2004 Nomura et al. ..... 399/110

(Continued)

FOREIGN PATENT DOCUMENTS

CN 1534399 A 10/2004
CN 1595307 A 3/2005

(Continued)

OTHER PUBLICATIONS

International Preliminary Report on Patentability dated Sep. 20, 2011, ("IPRP") in International Application No. PCT/JP2010/054901.

(Continued)

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

A color electrophotographic image forming apparatus in which a cartridge tray supporting a plurality of cartridges is movable through a plurality of opening portions to respective outside positions outside an apparatus main body. In the color electrophotographic image forming apparatus, the plurality of cartridges are removably mounted to the apparatus main body to form an image on a recording medium. The color electrophotographic image forming apparatus includes a cartridge tray, which is movable, while supporting the plurality of cartridges, between an inside position positioned inside the apparatus main body and the outside positions, a plurality of opening portions provided in the apparatus main body, through which the cartridge tray is movable between the inside position and the outside positions, and doors for opening and closing the plurality of opening portions.

9 Claims, 15 Drawing Sheets

(56) References Cited

U.S. PATENT DOCUMENTS

| | | | | |
|---|---|---|---|---|
| 7,065,305 | B2 | 6/2006 | Oyaide | |
| 7,184,688 | B2 * | 2/2007 | Ishii | 399/113 |
| 7,242,888 | B2 | 7/2007 | Ishii | |
| 2007/0160380 | A1 | 7/2007 | Imaizumi et al. | |
| 2008/0259364 | A1 | 10/2008 | Morita et al. | |
| 2009/0190955 | A1 * | 7/2009 | Igarashi et al. | 399/113 |
| 2010/0046980 | A1 * | 2/2010 | Imaizumi et al. | 399/90 |
| 2010/0196046 | A1 * | 8/2010 | Shimizu | 399/110 |

FOREIGN PATENT DOCUMENTS

| | | | |
|---|---|---|---|
| CN | 1670632 | A | 9/2005 |
| EP | 1816527 | A2 | 8/2007 |
| JP | 5-40369 | A | 2/1993 |

OTHER PUBLICATIONS

Chinese Office Action dated May 30, 2013, in related Chinese Patent Application No. 201080011688.3 (with English translation).

International Search Report and Written Opinion mailed Jul. 19, 2010, in International Application No. PCT/JP2010/054901.

* cited by examiner

CLOSED STATE OF DOOR 28

ON THE WAY TO OPEN STATE OF DOOR 28

FULLY OPEN STATE OF DOOR 28

COLOR ELECTROPHOTOGRAPHIC IMAGE FORMING APPARATUS

TECHNICAL FIELD

The present invention relates to a color electrophotographic image forming apparatus, in which a plurality of process cartridges are removably mounted to an apparatus main body to form an image on a recording medium.

BACKGROUND ART

In an electrophotographic image forming apparatus, there is known a process cartridge, in which an electrophotographic photosensitive drum and a process means that acts on the electrophotographic photosensitive drum are integrated into a cartridge, and the thus formed process cartridge is removably mounted to the apparatus main body. Then, in the color electrophotographic image forming apparatus for forming a color image, in which a plurality of colors are superimposed, the plurality of process cartridges for respective colors are used.

In the color electrophotographic image forming apparatus having a structure as described above, in which the plurality of process cartridges are removably mounted to the apparatus main body, there is known a structure in which a cartridge supporting member is movably provided with respect to the apparatus main body. Further, there is known one having a structure in which, under a state of supporting the plurality of process cartridges by the cartridge supporting member, the cartridge supporting member is inserted into the apparatus main body, or, is pulled out from the apparatus main body (U.S. Patent Application Publication No. 2007-0160380 A).

DISCLOSURE OF THE INVENTION

In the above-mentioned related art, there was provided one opening portion through which the cartridge supporting member is pulled out from the apparatus main body. For that reason, on a side having the opening portion, there are required to provide a space for sufficiently pulling out the cartridge supporting member. For that reason, there are existed limited conditions for installing the apparatus main body.

Further, in a case where a jamming of the recording medium occurs within the apparatus main body, in order to expose a conveyance path of the recording medium, it was required for the cartridge supporting member to be pulled out largely from the apparatus main body.

It is an object of the present invention to provide a color electrophotographic image forming apparatus, which enables a cartridge supporting member supporting a plurality of cartridges to move between an inside position and a plurality of outside positions positioned at different directions.

It is another object of the present invention to provide a color electrophotographic image forming apparatus, in which jam clearance operability is enhanced.

It is further another object of the present invention to provide a color electrophotographic image forming apparatus, in which a degree of freedom of an installation location of the color electrophotographic image forming apparatus is enhanced.

It is still another object of the present invention to provide a color electrophotographic image forming apparatus, in which the cartridge supporting member supporting the plurality of cartridges is allowed to be pulled out from an arbitrary opening portion among the plurality of opening portions, whereby a degree of freedom of installation of the image forming apparatus main body is enhanced.

A representative structure of the present invention for attaining the above-mentioned objects is a color electrophotographic image forming apparatus, in which a plurality of cartridges are removably mounted to an apparatus main body to form an image on a recording medium, including: a cartridge supporting member which moves between an inside position positioned inside the apparatus main body and outside positions positioned outside the apparatus main body, while supporting the plurality of cartridges; a plurality of opening portions formed in the apparatus main body, for moving the cartridge supporting member to the inside position and to the outside position; and a plurality of openable and closable member for opening and closing the plurality of opening portions.

According to the present invention, the cartridge supporting member supporting the plurality of cartridges is enabled to move between the inside position and the plurality of outside positions positioned in different directions.

According to the present invention, jam clearance operability is enhanced.

According to the present invention, a degree of freedom of an installation location when installing the color electrophotographic image forming apparatus is enhanced.

According to the present invention, a cartridge supporting member supporting a plurality of cartridges is enabled to be pulled out from an arbitrary opening portion among the plurality of opening portions, whereby a degree of freedom of installation of the image forming apparatus main body is enhanced.

Further features of the present invention will become apparent from the following description of exemplary embodiments with reference to the attached drawings.

BEST MODE FOR CARRYING OUT THE INVENTION

Figure 1A:
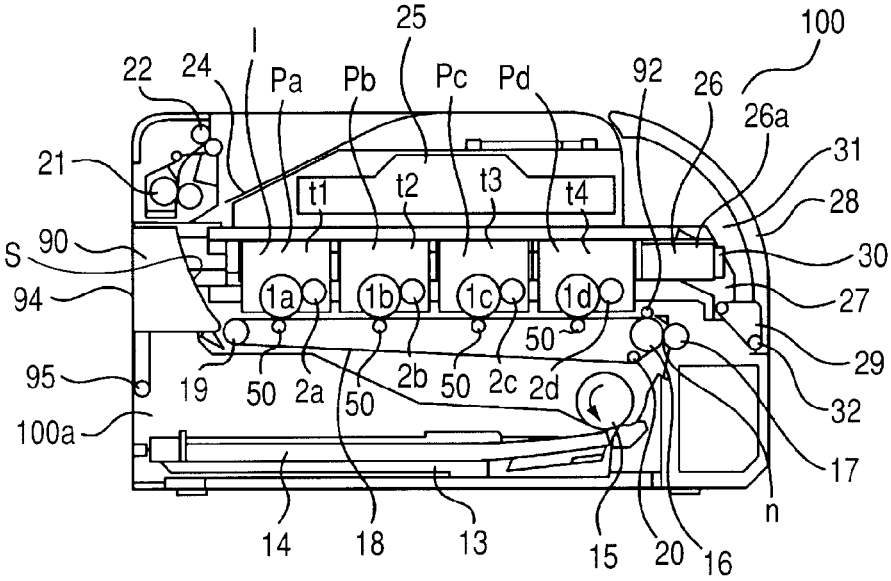
FIG. 1A is an explanatory sectional view of an image forming apparatus according to a first embodiment of the present invention, under a state in which a door is closed.

Next, referring to the drawings, a description will be provided of a color electrophotographic image forming apparatus, in which cartridges are removably mounted to an apparatus main body, to thereby form an image on the recording medium according to embodiments of the present invention.

Here, a color electrophotographic image forming apparatus forms a color image on a recording medium using an electrophotographic image forming process. Then, examples of the color electrophotographic image forming apparatus include a color electrophotographic copying machine, a color electrophotographic printer (for example, a color laser beam printer, a color LED printer, etc.), a color facsimile machine, and a color word processor.

Further, the recording medium is one on which an image is formed by the electrophotographic image forming apparatus. Examples of the recording medium include paper and an OHP sheet.

The "cartridge" refers, for example, to a process cartridge or a developing cartridge, and is removably mounted to the apparatus main body of the electrophotographic image forming apparatus. Then, the cartridge contributes to an image forming process to form an image on the recording medium. Here, the process cartridge is formed by integrating at least one of a charging means, a developing means, and a cleaning means serving as a process means and an electrophotographic photosensitive drum into a cartridge, and is removably mounted to the apparatus main body of the electrophotographic image forming apparatus. Accordingly, the process cartridge having a structure, in which the developing means serving as the process means and the electrophotographic photosensitive drum are integrally formed into a cartridge, and the cartridge is removably mounted to the apparatus main body of the electrophotographic image forming apparatus, is also included in its category. In addition, the process cartridge having a structure, in which the charging means, the developing means, or the cleaning means serving as the process means and the electrophotographic photosensitive drum are integrally formed into a cartridge, and is removably mounted to the apparatus main body, is also included in its category.

Note that, the process cartridge, which integrally includes an electrophotographic photosensitive drum and a developing means, is referred to as a so-called integral type process cartridge. Besides, the process cartridge, which integrally includes an electrophotographic photosensitive drum and a process means other than the developing means, is referred to as a so-called separation type process cartridge.

Here, the process cartridge allows mounting to and removing from the image forming apparatus main body by a user him/herself. As a result, maintenance of the apparatus main body may easily be conducted. The process means acts on the electrophotographic photosensitive drum.

Further, the developing cartridge refers to one which includes a developing roller, contains a developer (toner) used to develop an electrostatic latent image formed on the electrophotographic photosensitive drum by the developing roller, and is removably mounted to the apparatus main body. Note that, in a case of the developing cartridge, the electrophotographic photosensitive drum is mounted to the apparatus main body or a cartridge supporting member described later. Alternatively, the electrophotographic photosensitive drum is provided in the so-called separation type process cartridge (in this case, the process cartridge has no developing means). The developing cartridge also allows mounting to and removing from the image forming apparatus main body by the user him/herself. As a result, the maintenance of the apparatus main body may easily be conducted.

Therefore, the cartridge includes a so-called integral type or a so-called separation type process cartridge in its category. Further, the cartridge includes a case in which a so-called separation type process cartridge and the developing cartridge are used as a pair. Further, the cartridge may be one in which the electrophotographic photosensitive drum is mounted so as to be fixed to the apparatus main body or the cartridge supporting member described below, and in which the developing cartridge is removably used so as to be capable of acting on the electrophotographic photosensitive drum.

First Embodiment

Figure 1B:
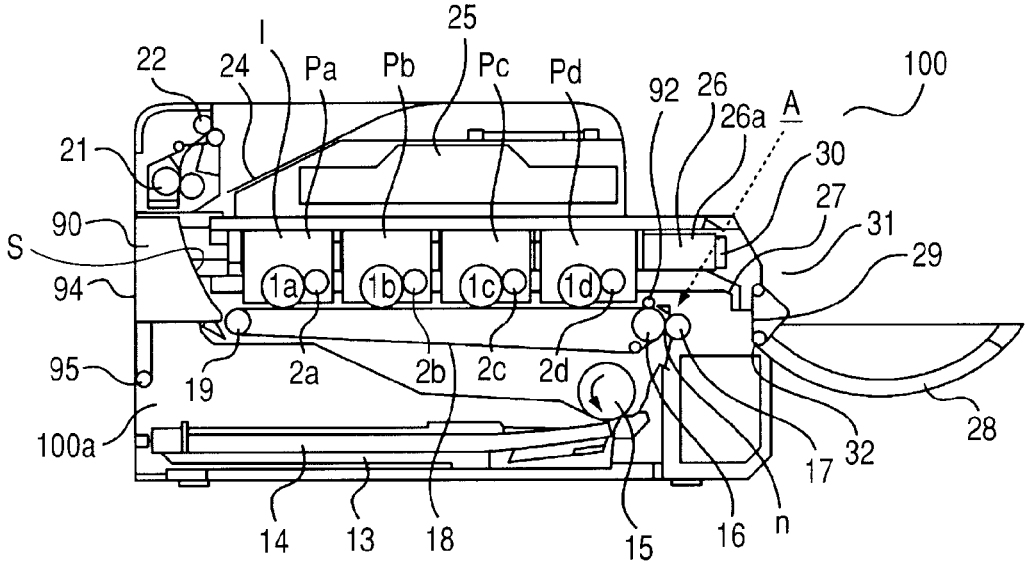
FIG. 1B is an explanatory sectional view of the image forming apparatus according to the first embodiment of the present invention, under a state in which the door is opened.

FIGS. 1A and 1B are cross-sectional illustrations of a laser printer, which being a color electrophotographic image forming apparatus according to a first embodiment of the present invention. Hereinafter, a description will be provided of a general structure and functions of the laser printer.

<General Structure of Color Electrophotographic Image Forming Apparatus>

First, referring to FIG. 1A, a description will be provided of a general structure of a color electrophotographic image forming apparatus according to a first embodiment of the present invention (hereinafter, referred to as an image forming apparatus). Note that, FIG. 1A is an explanatory sectional view of the image forming apparatus.

An image forming apparatus 100 of this embodiment is a full color laser printer using an electrophotographic process. Then, the image forming apparatus 100 forms an image on a recording medium (paper, OHP sheet, etc.) based on an image signal input from an external host apparatus (not shown) such as a personal computer, an image reader, or a facsimile apparatus of the other party.

In the following description, a front side (front face side) of the image forming apparatus 100 is a side on which a door (first openable and closable member) 28 is arranged. A rear side (depth side) is an opposite side thereto. Further, right and left refers to the right or left seen from the front side of the apparatus main body.

As illustrated in FIG. 1A, inside the image forming apparatus main body (hereinafter, referred to as an apparatus main body) 100*a*, a first to fourth of four process cartridges P (Pa, Pb, Pc, and Pd) are arranged in a horizontal direction from the rear side toward the front side. The plurality of process cartridges (hereinafter, referred to as cartridges) P are of the same structure except for colors of powder developers contained therein. Note that, a cartridge Pa contains a yellow color developer t1 (FIGS. 1A and 1B). Further, a cartridge Pb contains a magenta color developer t2 (FIGS. 1A and 1B). Further, a cartridge Pc contains a cyan color developer t3 (FIGS. 1A and 1B). Further, a cartridge Pd contains a black color developer t4 (FIGS. 1A and 1B).

Note that, in this embodiment, a description will be provided of an example in which so-called integral type cartridges are used as the cartridges P. However, the present invention is not limited to cases in which the integral type cartridges are used. As the cartridges P, the cartridge having the above-mentioned structure may be applicably used.

A laser scanner unit 25 is arranged above the cartridges P of an apparatus main body 100*a*. The scanner unit 25 scans and exposes each of surfaces of photosensitive drums 1 (1*a*, 1*b*, 1*c*, and 1*d*) of each of the cartridges P with a laser beam in accordance with image information. As a result, electrostatic latent images are successively formed on the photosensitive drums 1. Subsequently, the electrostatic latent images are developed by developing rollers (developing means) 2 (2*a*, 2*b*, 2*c*, and 2*d*), whereby developer images are formed on the photosensitive drums 1. Note that, on the photosensitive drum 1 of the cartridge Pa, a developer image of a yellow color is formed. Further, on the photosensitive drum 1 of the cartridge Pb, a developer image of a magenta color is formed. Further, on the photosensitive drum 1 of the cartridge Pc, a developer image of a cyan color is formed. Further, on the photosensitive drum 1 of the cartridge Pd, a developer image of a black color is formed.

A conveyer belt 18 for conveying a recording medium is disposed below the cartridges P mounted to the apparatus main body 100*a*. The conveyer belt 18 is suspended with tension by a drive roller 16, a driven roller 19, and a tension roller 20, and rotates counterclockwise (FIG. 1A). A lower surface of the photosensitive drum 1 of each of the cartridges P abuts against an upper surface of the conveyer belt 18.

Further, a conveyer roller 17 abuts against the conveyer belt 18 on its front side. Further, in the vicinity of the conveyer roller 17, an attracting roller 92 abuts against the conveyer belt 18. When conveying a recording medium 14, the recording medium 14 contained in a feeding tray (stacking portion) 13 is fed by a feeding roller 15 rotating counterclockwise (FIGS. 1A and 1B). Then, the recording medium 14 is sent to a nip portion between the drive roller 16 and the conveyer roller 17. Then, a voltage is applied to the attracting roller 92. With this, the conveyer belt 18 electrostatically attracts the recording medium 14 on an outer circumferential thereof. Then, the conveyer belt 18 circularly moves by the drive roller 16 so as to bring the recording medium 14 into contact with the photosensitive drums 1. With this, the recording medium 14 is conveyed to transfer positions by the conveyer belt 18. Through a bias application to transfer rollers 50 (FIGS. 1A and 1B), the toner images (developer images) on the photosensitive drums 1 are transferred onto the recording medium 14. Note that, the transfer positions are positions between the photosensitive drums 1 and the transfer rollers 50.

Further, the recording medium 14, onto which the developer images are transferred is sent to a fixing device 21, and heated and pressurized therein. With this, the developer images are fixed to the recording medium 14. The recording medium 14 on which developer images are fixed is discharged onto a delivery tray (receiving portion) 24 by a delivery roller pair 22. Note that, the above-mentioned respective colors of the developer images are superimposed and are transferred onto the recording medium 14.

In this embodiment, to enhance usability, there is employed a structure, in which a cartridge tray (a cartridge supporting member) 26 is pulled out from the apparatus main body 100 under a state in which the cartridges P are supported by (contained in) the cartridge tray 26. With this structure, an operability of the replacement of the cartridges P by the user is enhanced. The tray 26 is slidably supported with respect to the apparatus main body 100*a*.

<Cartridge Tray>

Next, a description will be provided of an operational structure of the cartridge tray 26 with reference to FIGS. 1A and 1B to FIGS. 4A and 4B.

As the first to fourth respective cartridges P are used more, the respective developers contained in the cartridges P are consumed. Then, when the developers are consumed, the replacement of the cartridges P is required.

Figure 4A:
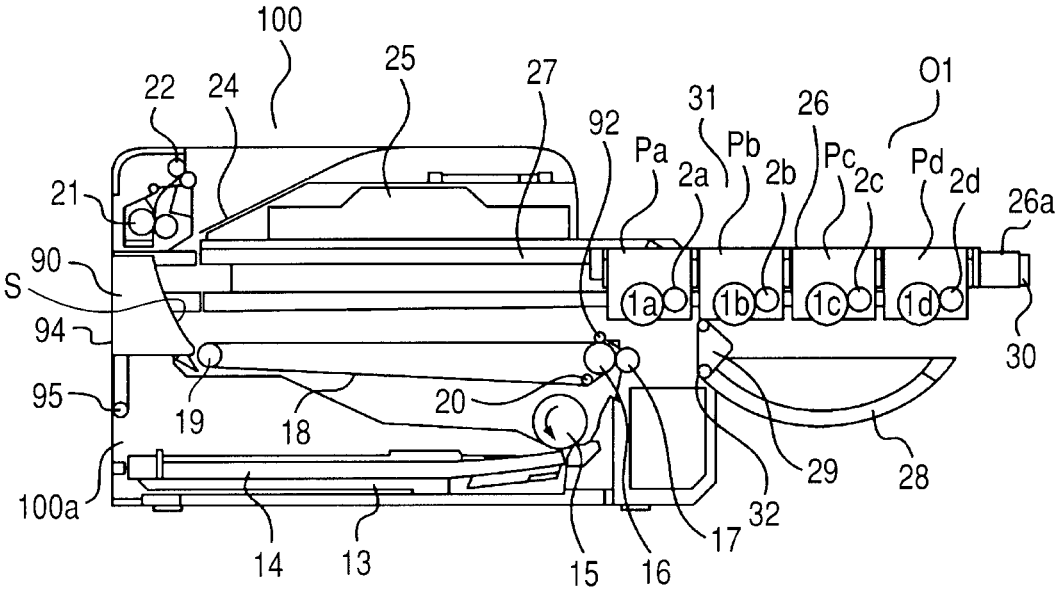
FIGS. 4A and 4B are diagrams illustrating replacement of cartridges according to the first embodiment of the present invention.
Figure 4B:
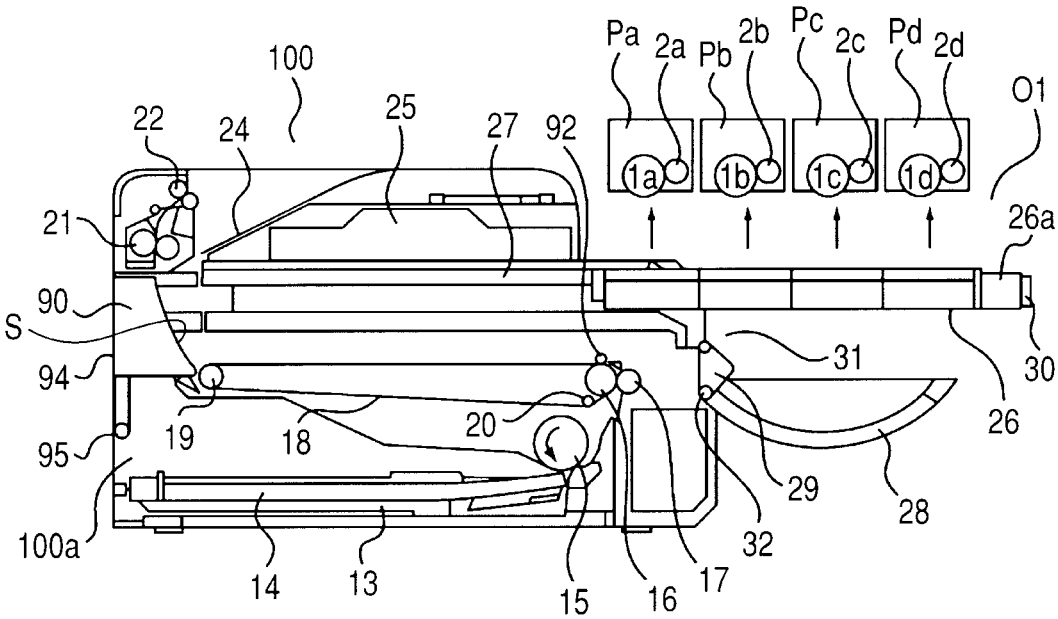

In the image forming apparatus of this embodiment, the replacement of the cartridges P is carried out, for the enhancement of usability, in such a manner that the cartridges P are mounted on the tray 26. With this, the replacement of the cartridges P by the user may be carried out under a state in which the tray 26 is pulled out from the apparatus main body 100*a* (FIGS. 4A and 4B). Accordingly, the user may carry out the replacement of the cartridges P under a state in which the cartridges P are exposed. As a result, the replacement operability of the cartridges P may be enhanced.

Specifically, the tray 26 is provided so as to be movable, while supporting the cartridges P, between an inside position I (FIGS. 1A and 1B) positioned inside the apparatus main body 100*a* and an outside position (first outside position) O1 (FIGS. 4A and 4B, FIG. 6) positioned outside the apparatus main body 100*a*.

For that reason, on the front side of the apparatus main body 100*a*, there is provided an opening portion (first opening portion) 31 for allowing the cartridges P to pass therethrough for inserting the cartridges P into the apparatus main body 100*a*, and for removing the cartridges P from the apparatus main body 100*a*. Specifically, the tray 26 passes through the opening portion 31.

Further, there is provided a door (first openable and closable member) 28, which is movable between a closing position for closing the opening portion 31 and an opening position for opening the opening portion 31. The door 28 is provided on the front side of the apparatus main body 100*a* (right side of FIG. 11). The door 28 closes the opening portion 31 so as to be openable.

In this embodiment, the door 28 is rotatable with respect to the apparatus main body 100*a* about hinge shafts 32 as centers, provided the lower portion of the door 28 (refer to FIGS. 1A and 1B). Specifically, the door 28 is rotated by the user in a direction so as to be turned-up about the hinge shafts 32 as the centers, thereby being capable of closing with respect to the apparatus main body 100*a*. With the closing operation of the door 28, the opening portion 31 is closed (FIGS. 1A and 1B). Further, the door 28 is rotated about the hinge shafts 32 as the centers by the user in a direction toward the front side of the apparatus main body 100*a*, thereby being capable of making the apparatus main body 100*a* into an opened state (FIGS. 4A and 4B). With this, the opening portion 31 of the front surface of the apparatus main body is largely opened.

On both sides inside the opening portion 31, there are provided a pair of right and left tray holding members (main body side guides) 27 (27L and 27R) of which a longitudinal direction extends in a fore-and-aft direction (FIGS. 1A and 1B to FIGS. 4A and 4B). Then, between the tray holding members 27L and 27R, the tray 26 is held so as to be slidably movable in the fore-and-aft direction. The cartridges P are roughly supported by the tray 26. Specifically, the tray holding members (main body side guides) 27L and 27R are provided at one end side and the other end side of the apparatus main body in a direction orthogonal to a moving direction of the tray 26. The tray 26 is provided with engage portions, at its side ends on the one end side and the other end side (not shown, support member side engaging portions), which engage with the tray holding members 27 and are slidable with respect to the tray holding members 27.

The tray holding members 27 and the door 28 are connected to each other through door links 29 (29L and 29R) disposed right and left. The user opens the door 28. Then, the door links 29, which are connected to the door 28, rotate and lift the tray holding members 27 obliquely upward through a link mechanism (described later). With this operation, the photosensitive drums 1 of the cartridges P supported by the tray 26 are spaced apart from the conveyer belt 18 (FIG. 1B). After that, the user pulls out the tray 26 while gripping a grip portion 30.

(Link Mechanism of Tray Holding Member)

Figure 2A:
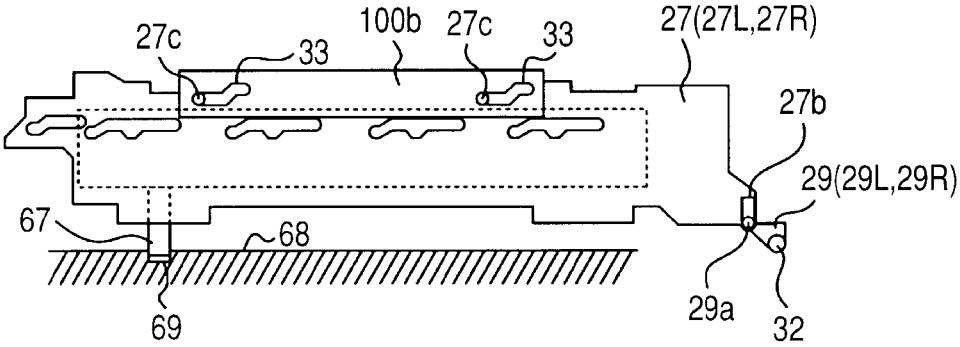
FIGS. 2A, 2B, and 2C are explanatory views of a link mechanism between a door and tray holding members according to the first embodiment of the present invention.
Figure 2B:
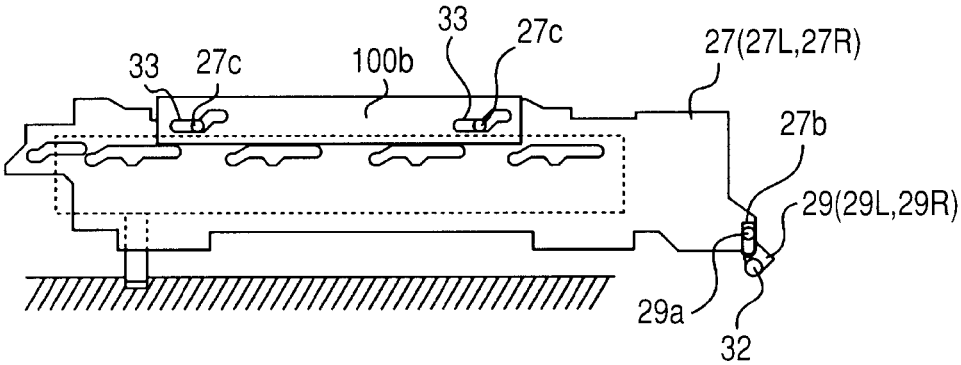
Figure 2C:
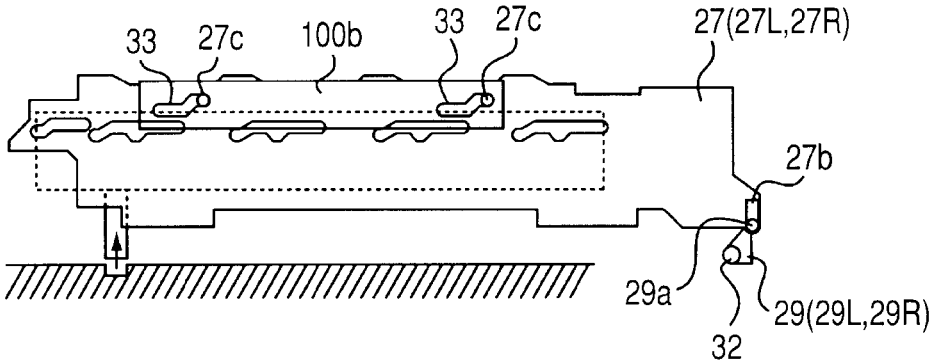

Here, a description will be provided of a structure of a link mechanism. FIGS. 2A to 2C illustrate, pin shafts 27*c* (one on each of right and left sides) provided on the tray holding members 27 and guide holes 33. The guide holes 33 are provided in main body side plates 100*b* (FIGS. 2A to 2C) provided in the apparatus main body 100*a*. Then, the tray holding members 27 are arranged symmetrically on both right and left sides of the main body 100*a*. Therefore, the right and left tray holding members 27 each have a degree of freedom of moving within a guide range of the guide holes 33 with respect to the right and left side plates 100*b*.

Figure 3:
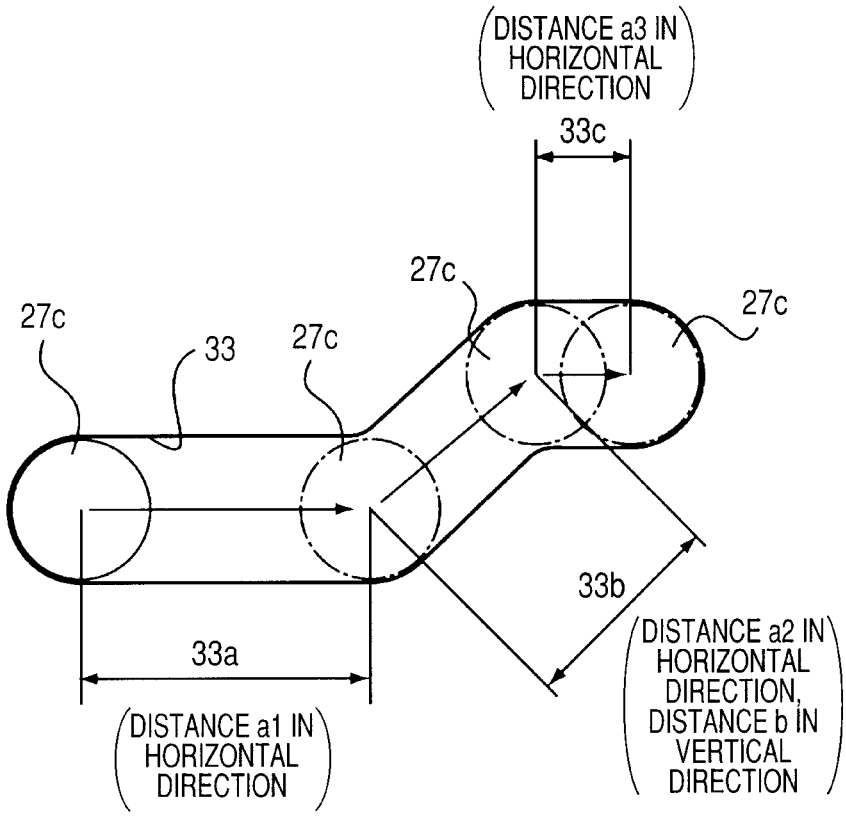
FIG. 3 is an explanatory view of the link mechanism of the door and the tray holding member according to the first embodiment of the present invention.

FIG. 3 is an enlarged view of one of the guide holes 33. Any of the guide holes 33 includes a first guide region 33*a*, which is horizontal in a fore-and-aft direction, and a rising slope second guide region 33*b*, which is continuous with the first guide region 33*a* in a pin shaft advancing direction. Further, any of the guide holes 33 includes a third guide region 33*c*, which is continuous with a top of the second guide region 33*b*, and which receives and stably holds the pin shaft 27*c*. The pin shafts 27*c*, namely, the right and left tray holding members 27 move a distance of "a1" in a horizontal direction in the first guide region 33*a* in association with an opening rotation of the door 28, and then move obliquely upward (a distance "a2" in a horizontal direction, and a distance "b" in a vertical direction) in the second guide region 33*b*. Then, finally, the right and the left tray holding members 27 move a distance of "a3" in the horizontal direction in the third guide region 33*c*.

FIG. 2A illustrates a state in which the door 28 is completely closed with respect to the apparatus main body 100*a*. In this state, the right and left tray holding members 27 are moved in the rear direction within the apparatus main body through the hinge shafts 32, the door links 29, the link axes 29*a*, and vertically elongated holes 27*b*. For that reason, the right and left tray holding members 27 are held at a predetermined lower position with respect to the main body side plates 100*b*.

Accordingly, the tray 26 held by the tray holding members 27 is also held at the lower position which is lowered by a predetermined distance. At this time, the photosensitive drums 1 of the cartridges P supported by the tray 26 abut against the recording medium 14 conveyed by the conveyer belt 18, whereby the toner image may be transferred. Specifically, the tray 26 locates at the inside position I, and holds the cartridges P at the image formation position which contributes to an image forming process for forming an image on the recording medium 14 (FIG. 1A). In this embodiment, in the cartridges P positioned at the image formation position, the drums 1 are brought into contact with the belt 18.

FIG. 2B illustrates a state in which the door 28 is opened halfway. If the door 28 is opened from a state in which the door 28 is closed (FIG. 2A), in association with this operation, the right and left tray holding members 27 are pulled in the front direction within the apparatus main body 100*a*. With this operation, the tray holding members 27 first moves forward the predetermined distance of "a1" in the horizontal direction by the pin shafts 27*c* being guided by the first guide region 33*a* of the guide holes 33.

In association with a successive operation of opening the door 28, the tray holding members 27 are further pulled forward within the apparatus main body 100*a*. With this operation, the tray holding members 27 move obliquely upward by the pin shafts 27*c* being guided by the second guide region 33*b* of the guide holes 33 (from FIG. 2A to FIG. 2C).

FIG. 2C illustrates a state in which the door 28 is completely opened. In this state, the tray holding members 27 finish their obliquely upward movement by the second guide region 33*b*, and then the pin shafts 27*c* are positioned at the horizontal third guide region 33*c*. Specifically, the tray holding members 27 move obliquely upward, and move in the horizontal direction thereafter. This is to stabilize the positions in the height direction of the cartridges P and the tray holding members 27, when the tray 26 is pulled out from the tray holding members 27, and the replacement of the cartridges P is performed, thereafter. Further, this is to regulate (prevent) the tray holding members 27 from returning to original positions.

In a case where the pin shafts 27*c* are positioned at the guide region 33*c*, and at the positions of the tray holding members 27, the tray 26 also moves upward so that the photosensitive drum is lifted up from the conveyer belt 18. As a result, the tray 26 becomes available to be pulled out from the image forming apparatus 100 (from FIG. 1A to FIG. 1B).

Figure 6:
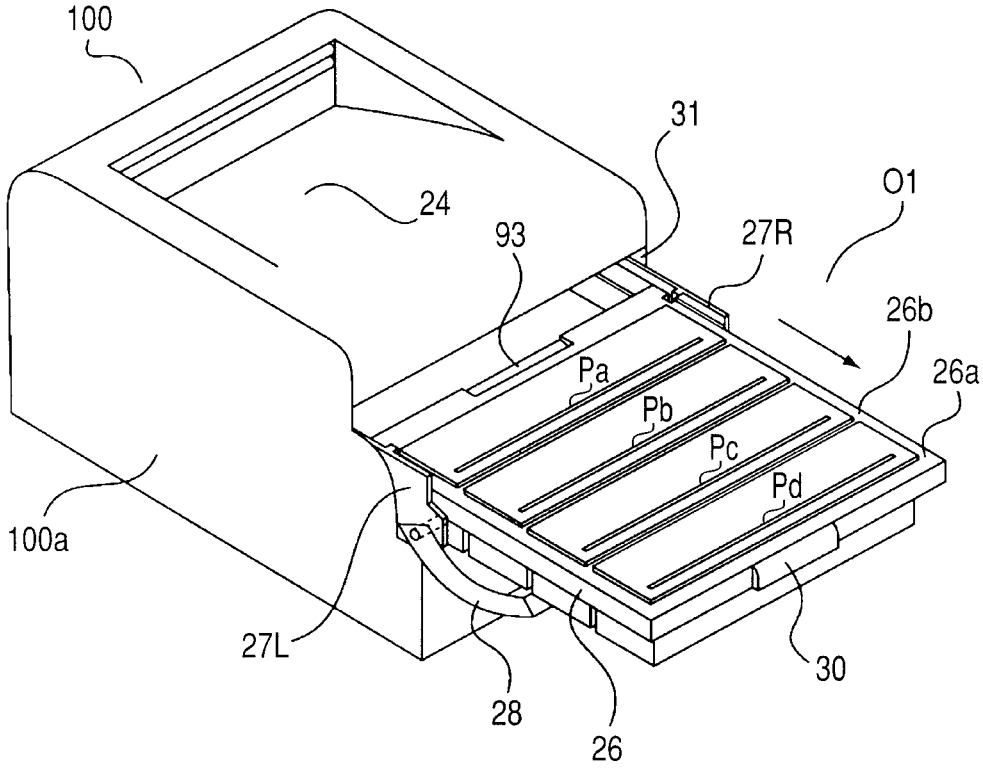
FIG. 6 is a perspective view illustrating the replacement of the cartridges according to the first embodiment of the present invention.

FIG. 4A illustrates a state in which the tray 26 is pulled out. In this state, top surfaces of the cartridges P are opened, and hence the respective cartridges P may be removed by the user. Then, as illustrated in FIG. 4B, if the tray 26 moves to an outside position O1, all the cartridges P become removable. Note that, according to this embodiment, in the pull out direction, the tray 26 is pulled out so that the cartridge Pa held most upstream of the tray 26 is pulled out outside the opening portion 31 (to the outside position O1) (FIG. 6). However, this embodiment is not limited thereto. For example, even if the tray 26 is pulled out to the maximum, the cartridge Pa may be positioned inside the opening portion 31. Because, even in this case, as the cartridge Pa is pulled out toward the forward side of the apparatus main body 100*a*, the replacement operability of the cartridge Pa may be enhanced. Accordingly, even in such a case, it says that the tray 26 is positioned at the outside position O1.

When mounting the cartridges P onto the main body, the reverse procedure is conducted. Specifically, under a state in which the tray 26 is pulled out, the cartridges P are placed (supported) on the tray 26. Then, the tray 26 is received (pushed in) inside the image forming apparatus 100. Then, the door 28 is closed. With this operation, the tray holding members 27 are pushed-down toward a lower left of FIG. 1B through an intermediation of a link 29. With this operation, the tray 26 also moves down, and the photosensitive drums 1 are brought into contact with the belt 18 (FIG. 1A). According to the above-mentioned embodiment, the tray 26 is raised in association with the movement of the door (first openable and closable member) 28 in an opening direction to open the opening portion (the first opening portion) 31. Also, the tray 26 is lowered in association with the movement of the door 28 in a closing direction to close the opening portion 31. Then, the cartridges P supported by the tray 26 are positioned at the image formation position.

Figure 5A:
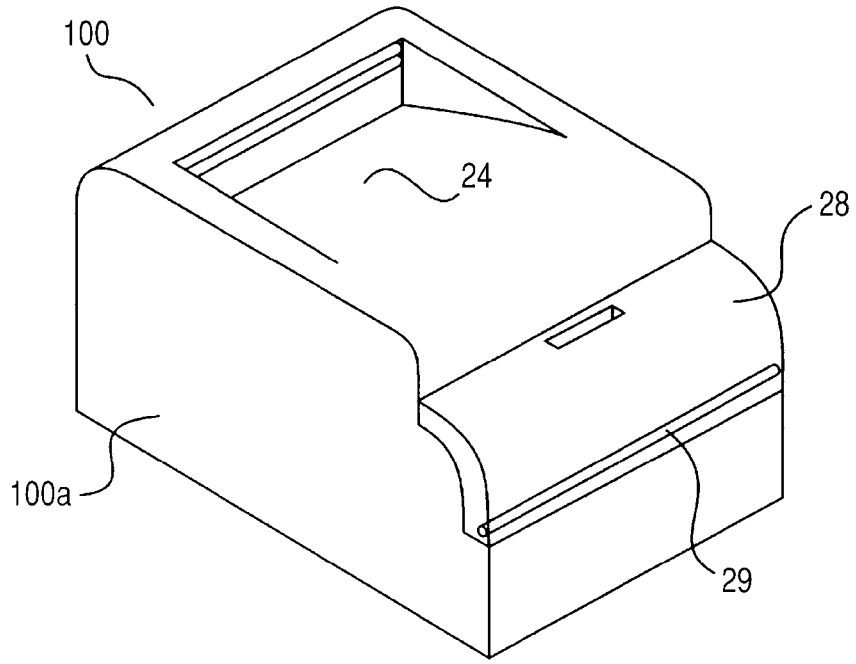
FIG. 5A is a perspective view of the image forming apparatus in a door-closed state according to the first embodiment of the present invention.
Figure 5B:
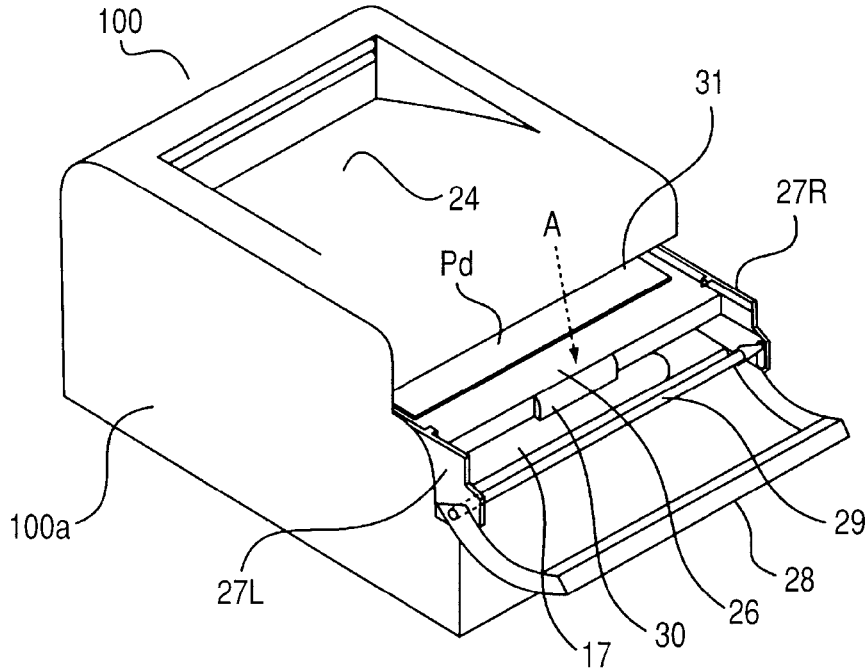
FIG. 5B is a perspective view of the image forming apparatus in a door-opened state according to the first embodiment of the present invention.

FIGS. 5A and 5B and FIG. 6 are perspective views of the apparatus main body. FIG. 5A illustrates the closed state of the door 28, FIG. 5B illustrates the opened state of the door 28, and FIG. 6 illustrates the state in which the door 28 is opened, and the tray 26 is pulled out.

(Removal of Cartridge Tray from Another Opening Portion)

Next, referring to FIGS. 7A and 7B to FIG. 10, a description will be provided of an interrelation between a pull-out structure of the tray 26 and jam clearance at a roller nip portion "n" (FIGS. 1A and 1B).

In the nip portion "n" serving as a conveyer portion of the recording medium 14 between the drive roller 16 and the conveyer roller 17, even if the door 28 is merely opened, the nip portion "n" is covered with an end portion 26*a* of the tray 26 (refer to a portion A of FIG. 1B and FIG. 5B). For that reason, by merely opening the door 28, the user hardly observes the nip portion "n". In addition, in a case where the jamming of the recording medium 14 occurs in the nip portion "n", the space is small for the user for the jam clearance in order to take-out the jammed recording medium 14 by inserting his/her hand into the nip portion "n". Accordingly, the jam clearance is not easy. Here, the end portion (26*a*) refers to, in this embodiment, an end portion of an outer frame 26*b* (FIG. 6) of the tray 26, and is the grip portion 30, but is not limited thereto. For example, the end portion may be only the end portion of the outer frame 26*b*, or, only the grip portion 30, or may be the cartridge Pb. In order to downsize the apparatus main body 100*a* as small as possible, in particular, downsizing a size of the apparatus main body 100*a* in the moving direction of the tray 26, such a measure may be taken.

Figure 7A:
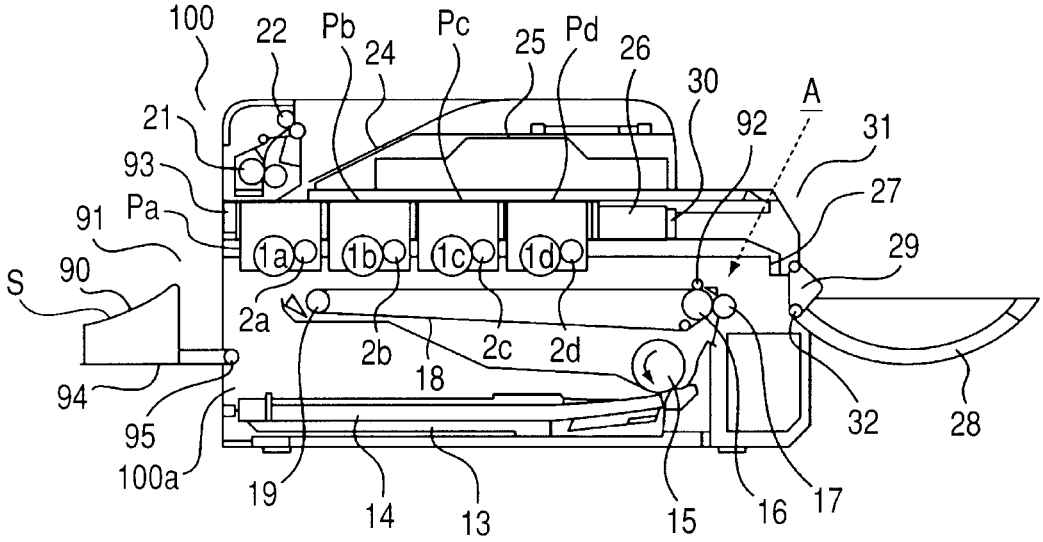
FIGS. 7A and 7B are diagrams illustrating the replacement of the cartridges and jam clearance according to the first embodiment of the present invention.
Figure 7B:
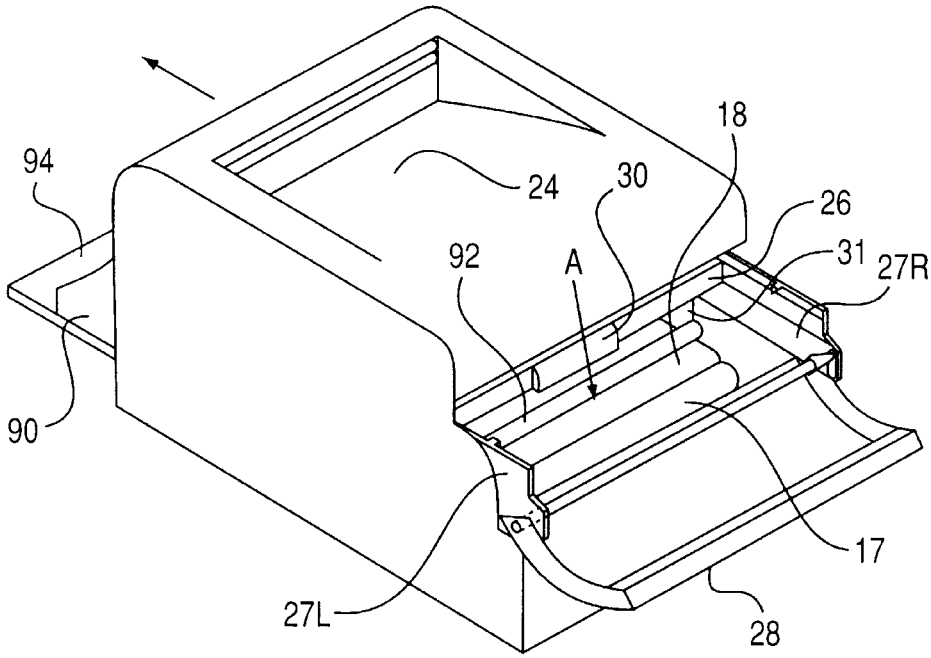

For that reason, in this embodiment, as illustrated in FIGS. 7A and 7B, an opening portion (a second opening portion) 91 is provided on an opposite side (rear side) of the apparatus main body 100*a*, which is opposite to the side (front side) at which the door (first openable and closable member) 28 is provided. The opening portion 91 is provided at the rear side (the left side of FIG. 11) of the apparatus main body. In order to insert or remove the cartridges P into/from the apparatus main body 100*a*, the opening portion 91 for allowing the cartridges P to pass therethrough is provided. The opening portion 91 is arranged so as to oppose to the opening portion 31. Specifically, at the both sides of the moving direction of the tray 26, the opening portions 31 and 91 are provided. In the pull out direction for pulling out the tray 26 from the inside position I to the outside position O2, the opening portion 91 is arranged at one end of the upstream of the apparatus main body 100*a*. Further, in the pull out direction, at one end of the downstream of the apparatus main body 100*a*, the opening portion 31 is arranged.

Then, at the opening portion 91, too, a door (a second openable and closable member) 94, which is movable between the closing position for closing the opening portion 91 and an opening position for opening the opening portion 91. A door 94 is rotatably provided about hinge shafts 95 as centers. In an inner surface of the door 94, a guide portion 90 for guiding the recording medium 14 to be conveyed by the conveyer belt 18 to the fixing device 21 is formed integrally with the door 94. For that reason, when the user opens the door 94, the guide portion 90 also integrally rotates. With this operation, the rear side of the tray 26 is exposed. Then, the grip portion 93 is also provided to the tray 26 at an end portion, which is opposite side (rear side) to the side (front side) at which the grip portion 30 is provided. Accordingly, through an operation of the user for opening the door 94, the tray 26 may be pulled out from the opening portion 91 of the rear side of the apparatus 100 while the user grips the grip portion 93. Specifically, according to this embodiment, the tray 26 may be moved to a direction opposite to the direction for pulling out the tray 26 from the opening portion 31. Then, the tray 26 may be pulled out from the opening portion 91.

Specifically, in a case where the jamming of the recording medium 14 occurs at the nip portion "n" between the drive roller 16 and the conveyer roller 17, the user first opens the front door 28 in order to perform the jam clearance. With this operation, as described above, the tray 26 is raised through an action of the link 29, and the photosensitive drums 1 are moved to positions at which the photosensitive drums 1 are replaceable. Next, the rear side door 94 of the apparatus 100 is opened. Then, the user pulls out the tray 26 from the opening portion 91 while gripping the grip portion 93. With this operation, the nip portion "n" as the conveyance path for the recording medium 14 between the drive roller 16 and the conveyer roller 17 are exposed (portion A of FIGS. 7A and 7B). As a result, the jam clearance may easily be performed from the opening portion 31 of the door 28.

Note that, when pulling out the tray 26 from the opening portion 91, instead of pulling out the tray 26 while gripping the grip portion 93 of the rear side as described above, the tray 26 may be pushed in from the opening portion 31 while the user grips the front side grip portion 30. Also in this case, the jam clearance may be performed at the nip portion "n" while projecting the tray 26 from the opening portion 91.

Figure 8A:
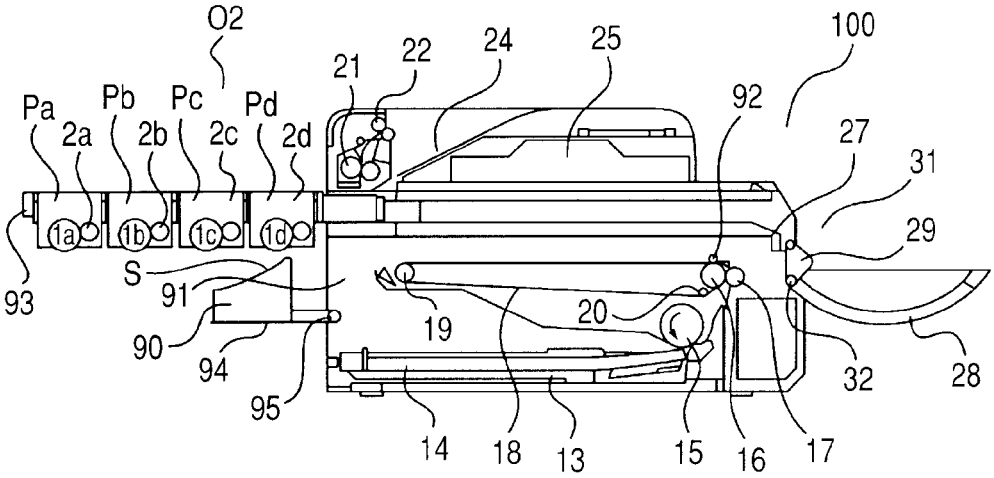
FIGS. 8A and 8B are diagrams illustrating the replacement of the cartridges according to the first embodiment of the present invention.
Figure 8B:
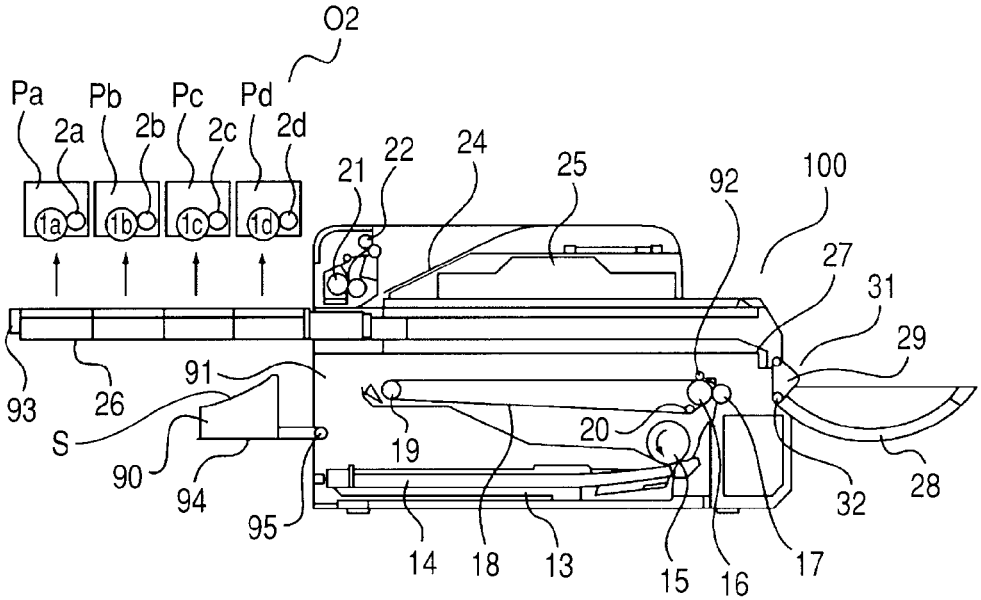

In addition, as illustrated in FIG. 8A, the tray 26 is further pulled out. With this operation, the top of the cartridges P is exposed, the respective cartridges P become removable (FIG. 8B).

Figure 9A:
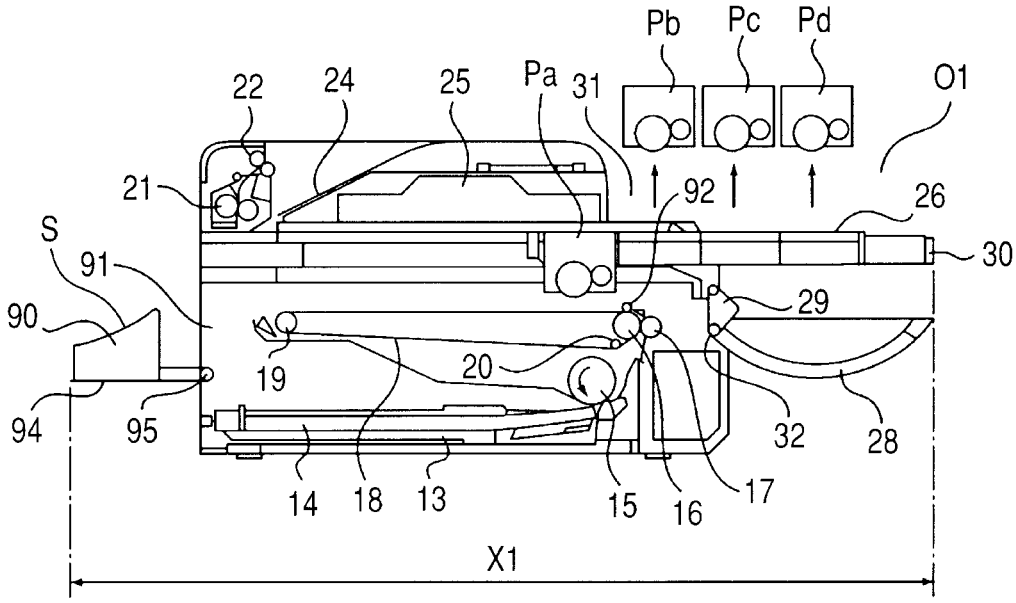
FIGS. 9A and 9B are diagrams illustrating the replacement of the cartridges from the opening portions provided in a front side and a rear side of the apparatus main body according to the first embodiment of the present invention.
Figure 9B:
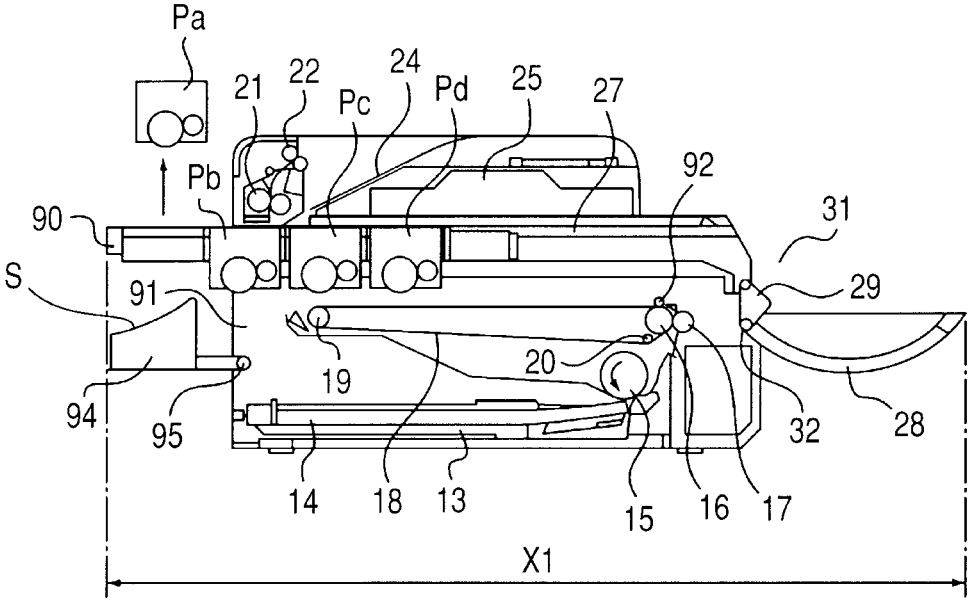

Further, in this state, the user may arbitrary pull out the tray 26 from both sides in the fore-and-aft direction of the apparatus main body 100*a*. For example, as illustrated in FIGS. 9A and 9B, from the opening portion 31, three cartridges Pb, Pc, and Pd are removed. Then, the rest one cartridge Pa may be removed from the opening portion 91. Note that, in this case, instead of pulling out the tray 26, the tray 26 may be pushed out from one side of the opening portion 31 or 91 to the other side of the opening portion 91 or 31. The opening portion 31 is arranged at the front side of the apparatus main body, and the opening portion 91 is arranged at the rear side of the apparatus main body. By passing the tray 26 through the opening portion 91, the tray 26 may be pulled out to a second outside position O2, which is in a different direction from the first outside position O1. According to this embodiment, when the tray 26 is pushed in from the opening portion 31, the tray 26 projects from the opening portion 91 to the outside position O2.

As described above, if it is constructed such that the cartridges are removed from each of the opening portion 31 or/and 91, as illustrated in FIGS. 9A and 9B, the space at the front side of the apparatus main body for the installation thereof is sufficient as long as three cartridges Pb, Pc, and Pd may be pulled out. On the other hand, as for the space at the back side of the apparatus main body for the installation thereof, if the space capable of opening the door 28 is secured, one cartridge Pa may be pulled out. Specifically, according to this embodiment, there may be obtained a degree of freedom for the installation place of the apparatus 100.

Figure 10:
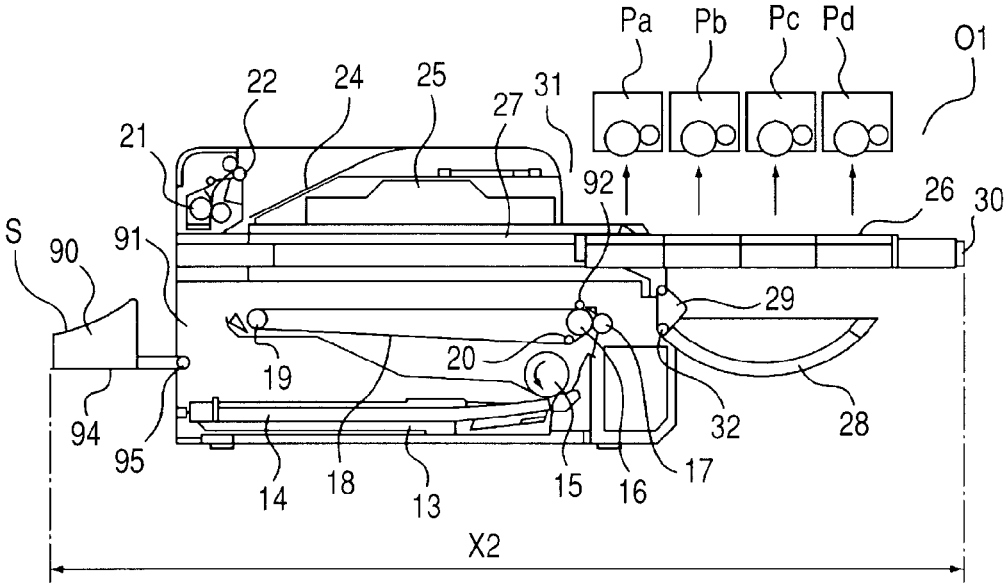
FIG. 10 is a diagram illustrating the replacement of the cartridges from the front-side opening portion.

On the other hand, as illustrated in FIG. 10, if it is constructed such that four cartridges are removed from only the front side opening portion 31, it is necessary to secure the space in which the door 28 may be opened as the space at the rear side of the apparatus main body for the installation thereof, which being the same with a case of FIGS. 9A and 9B. Then, as the space at the front side of the apparatus main body for the installation thereof, it becomes necessary that the four cartridges P may be pulled out. Note that, under a state in which the tray 26 is pulled out from the opening portion 31, if the door 94 is opened, a conveyance path S for the recording medium 14 is exposed (FIG. 10). Accordingly, the taking-out operability of the recording medium 14 jammed within the apparatus main body may be enhanced. According to this embodiment, at the inner side of the door 94, the conveyance path S for guiding the recording medium 14, on which developer images are superimposed and transferred from the photosensitive drums 1 of the respective cartridges P, to the delivery tray (receiving portion) 24, is provided. The delivery tray 24 receives the recording medium 14, onto which the developer images transferred from the photosensitive drums 1 are fixed by the fixing device 21. Note that, the delivery tray 24 is provided outside the apparatus main body 100*a*.

Accordingly, as the installation space of the image forming apparatus, the installation space (X1 of FIGS. 9A and 9B) of a case where it is constructed such that the cartridges are removed from the fore-and-aft of the apparatus main body is enough smaller than the installation space (X2 of FIG. 10) of a case where it is constructed such that all the cartridges P are removed from the front side of the apparatus main body. Further, the selectivity of the installation space of the apparatus is enhanced.

By constructing as described above, after opening the front door 28 and moving the tray 26 to a position at which the cartridges are replaceable, the door 94 is opened so that the cartridges P may be replaceable from any of the right and left doors of the apparatus main body 100*a*. In addition, the jam clearance of the recording medium 14 at the conveying portion may easily be performed, thereby being capable of enhancing the operability. Note that, this embodiment may also be effectively applied to the following case. Specifically, this embodiment may be effectively applied to an apparatus 100 having a structure in which a part (an end portion 26*a*) of the tray 26 does not cover the nip portion "n" under a state in which the door 28 is opened. Because, as described above, according to this embodiment, the tray 26 may be pulled out from any one of the opening portion 31 and the opening portion 91.

Accordingly, the degree of freedom at the time of the installation of the apparatus 100 may be increased. Because, according to the apparatus 100 employing this embodiment, when the apparatus 100 is installed, the opening portion 31 may be installed closely to installed goods (not shown) in the room. In a case where the apparatus 100 is to be installed as described above, in general, it may be constructed such that the tray 26 is pulled out from the opening portion 91 to carry out the replacement of the cartridges P. Note that, the installed goods are, for example, walls, partition plates, bookends, and the like. Further, the opening portion 91 may be installed closely to the installed goods (not shown) in the room. In a case where the apparatus 100 is to be installed as described above, in general, it may be constructed such that the tray 26 is pulled out from the opening portion 31 to carry out the replacement of the cartridges P.

Then, in any one of the above-mentioned cases, if the jamming of the recording medium 14 is occurred, the direction of the apparatus 100 is changed, and the jammed recording medium 14 may be taken-out from the opposite opening portion 91. Accordingly, according to this embodiment, the degree of freedom for the installation of the apparatus 100 may be increased, and the jam clearance may easily be performed. According to this embodiment, the conveyer belt 18 is provided so as to be in contact with the photosensitive drums 1 of the cartridges P supported by the tray 26 positioned at the inside position I. Then, the recording medium 14 is conveyed by the conveyer belt 18 from a side on which the opening portion 31 is provided toward a side on which the opening portion 91 is provided. With this operation, the recording medium 14, onto which the developer images are transferred from the photosensitive drums 1, is conveyed to the delivery tray 24 provided outside the apparatus main body while passing through the inner side of the door 94. At the inner side of the door 94, the conveyance path S is formed. Accordingly, the removal of the jammed recording medium 14 may be facilitated.

Second Embodiment

Next, a description will be provided of an electrophotographic image forming apparatus according to a second embodiment of the present invention with reference to FIG. 11 to FIGS. 15A to 15C. It should be noted that the basic structure of this embodiment is the same with the above-mentioned embodiment, and hence duplicate description is omitted. Here, a description will be provided of characteristic structures of this embodiment. Further, for the members having the same functions as the above-mentioned embodiment, the same reference symbols are used.

In the first embodiment, in order that the tray 26 is removed from the opening portion 91, first, the door 28 is opened. Because of this, the link 29 is required to operate. This is because it is necessary to raise the tray 26 by operating the link 29, and to separate the photosensitive drums 1 from the conveyer belt 18.

Contrary to this, in this embodiment, when removing the tray 26 from the opening portion 91, the user may realize the removal by only accessing to the rear side door (the second openable and closable member) 94. Specifically, without an opening operation of the door 28 by the user, the tray 26 may be removed from the opening portion 91 by opening the door 94. With this, the enhancement of convenience at the time of replacement of the cartridges P may further be enhanced.

Figure 11:
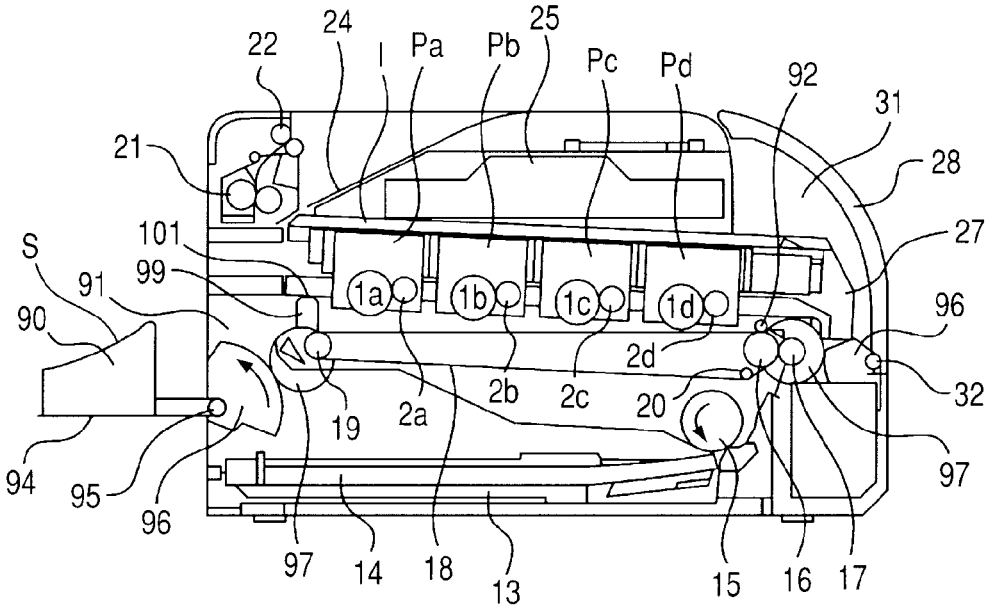
FIG. 11 is a diagram illustrating an image forming apparatus in a rear door opened-state according to a second embodiment of the present invention.

FIG. 11 illustrates a state in which the door 94 only is opened. To the door 94 of this embodiment, a link mechanism for raising the tray 26 is provided. For that reason, if the door 94 is opened, as illustrated in FIG. 11, the photosensitive drums 1 are spaced apart from the conveyer belt 18. With this operation, the tray 26 becomes removable from the main body. According to the above-mentioned embodiment, the opening portion 31 is provided upstream in the movement direction of the tray 26 with respect to the apparatus main body 100*a*. Further, the opening portion 91 is provided downstream in the movement direction, and the opening portion 31 and the opening portion 91 are disposed opposite to each other.

(Link Mechanism of Tray Holding Members)

Figure 12A:
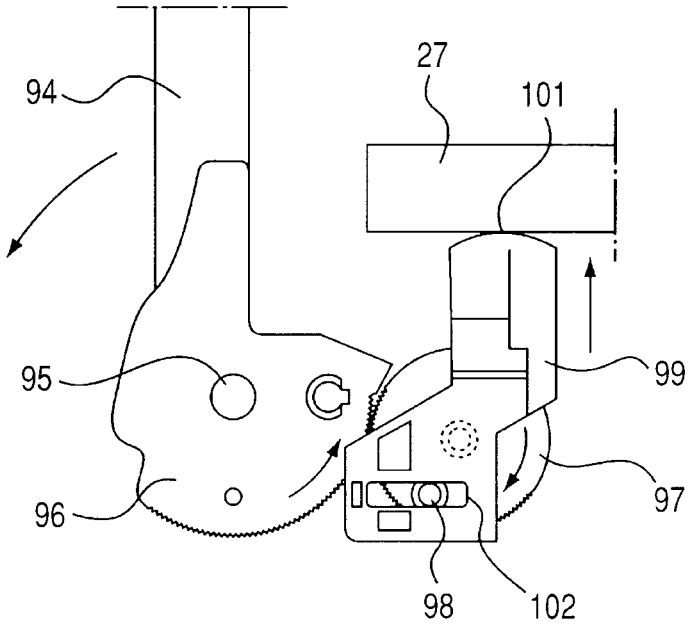
FIGS. 12A and 12B are diagrams illustrating a link mechanism between a door and a cartridge tray according to the second embodiment of the present invention.

Here, a description will be provided of a specific structure of a link mechanism of this embodiment. As illustrated in FIG. 12A, the door 94 is provided with a link gear 96. Further, a raising and lowering gear 97 engaging with the link gear 96 is provided. The gear 96 is rotatably provided coaxially with the hinge shaft 95 of the door 94, and rotates integrally with the door 94. For that reason, the gear 96 rotates counterclockwise about the hinge shaft 95 in association with an opening operation of the door 94. With this operation, the gear 97 engaging with the gear 96 is rotated clockwise. A boss 98 is formed on a gear end surface of the gear 97. The boss 98 moves upward while being rotated clockwise in association with the rotation of the gear 97.

Further, a raising and lowering rod 99 is provided so as to be movable up and down (in the vertical direction) with respect to the apparatus main body 100*a*, while being guided by guide portions (not shown). In the rod 99, there is formed a rectangular hole 102. The hole 102 is constructed so as to fit on the boss 98. Along with the rotation and rise up of the boss 98, the rod 99 is also supported so as to rise up.

Figure 12B:
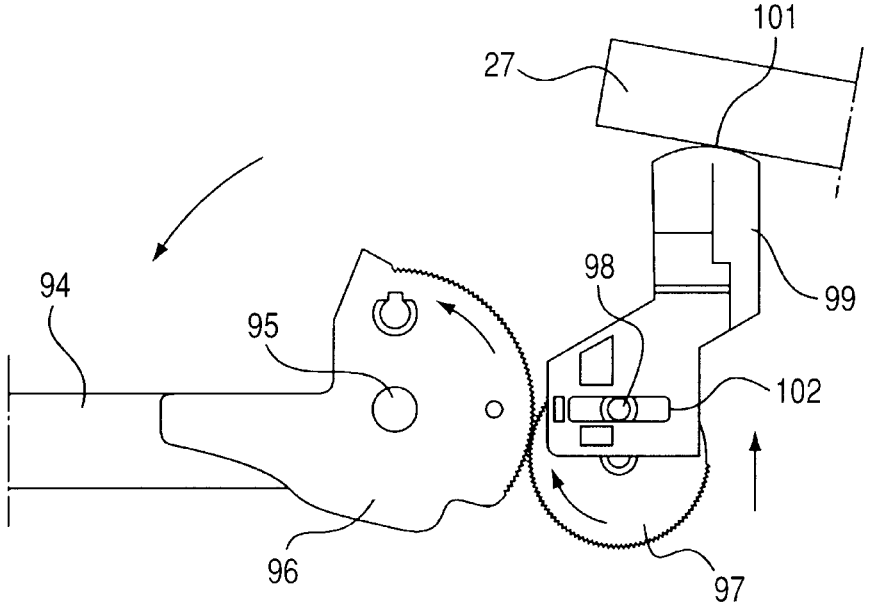

In addition, as illustrated in FIG. 12B, a cam surface 101 formed on a top surface of the rod 99 is in contact with a lower surface of the tray holding members 27. Then, the cam surface 101 supports the tray holding members 27 so that the tray holding members 27 and the tray 26 is movable up and down in association with the up-and-down movement (the vertical movement) of the rod 99. Specifically, the cam surface 101 lowers the tray holding members 27 and the tray 26 in association with the lowering of the rod 99. Further, the cam surface 101 raises the tray holding members 27 and the tray 26 in association with the rising of the rod 99.

Figure 13A:
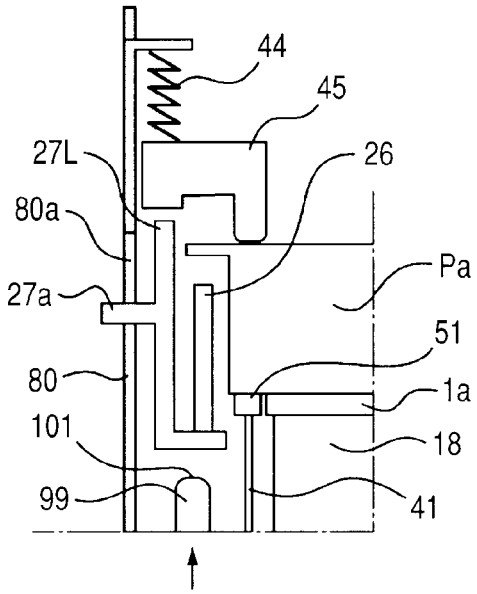
FIGS. 13A, 13B, and 13C are diagrams illustrating the link mechanism between the door and the cartridge tray according to the second embodiment of the present invention.
Figure 13B:
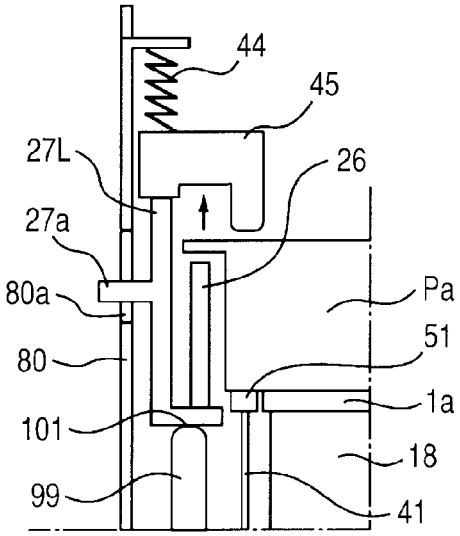
Figure 13C:
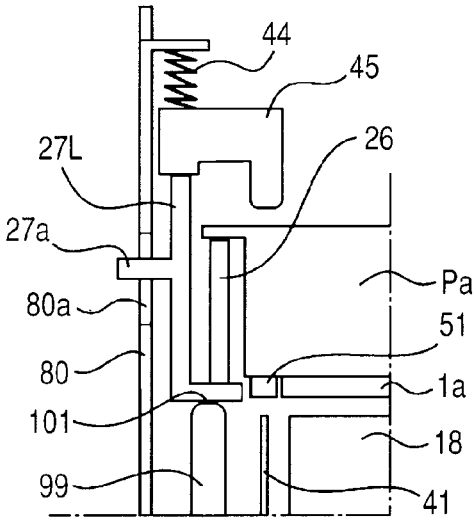

Next, referring to FIGS. 13A, 13B, and 13C, a description will be provided of an associated structure of the opening and closing operation of the door 94 and a pressing mechanism pressing on the tray 26 and the cartridges P. Note that, FIGS. 13A, 13B, and 13C illustrate the link mechanism, which raises and lowers the tray holding member 27L provided inside and left side of the apparatus main body. However, the same link mechanism, which raises and lowers the tray holding member 27R, is provided to the opposite right side of the apparatus main body. As for the link mechanism provided on the right side, illustrations thereof are omitted.

FIG. 13A illustrates a state in which the door 94 is closed. The cartridge Pa is pressed downward by a pressing member 45, which is elastically urged downward by a pressing spring (an elastic member) 44. A cartridge positioning portion 51 is held in a state in which the cartridge positioning portion 51 is in contact with a predetermined position of a positioning member 41. At this time, the lower surface of the photosensitive drum la is in contact with the conveyer belt 18. The tray holding member 27L is supported to a main body side plate 80 by the guide member (not shown). In the tray holding member 27L, the boss portion 27*a* of the tray holding member 27L is guided by a vertically elongated hole 80*a* formed in the side plate 80. With this structure, the tray holding member 27L is constructed so as to be movable in the up-and-down direction (the vertical direction). As illustrated in FIG. 13A, under a state in which the door 94 is closed, the tray 26 held by the tray holding member 27L is out of contact with the cartridge Pa. In this state, the cartridge Pa is secured to a predetermined position (a body side positioning portion (not shown)) by the pressing member 45, thereby being capable of executing a stable image forming operation without a contact or interference of other members.

FIGS. 13B and 13C illustrate a state in which, from this state, the cartridge Pa is being raised as the door 94 is being opened more.

FIG. 13B illustrates a state in a half way of opening the door 94. In association with the opening of the door 94, as described above, the rod 99 arranged inside the apparatus main body is raised. Then, the cam surface 101 of the rod 99 is brought into contact with the lower surface of the tray holding member 27L. After that, as the door 94 is further opened, the upper surface of the tray holding member 27L is brought into contact with the pressing member 45. Then, the tray holding member 27L lifts up the pressing member 45 against the pressing force (elastic force) of the spring 44, so that the pressing member 45 is spaced apart from the cartridge Pa. At this time, the lower surface of the photosensitive drum la is still in contact with the conveyer belt 18.

FIG. 13C illustrates a state in which the door 94 is fully opened. From the state as illustrated in FIG. 13B, the door 94 is further opened. Then, the tray 26, which is held by the tray holding member 27L, is brought into contact with the cartridge Pa to raise the cartridge Pa upward. Along with this operation, the positioning portion 51 is spaced apart from the positioning member 41. At the same time, the photosensitive drum 1*a* is also spaced apart from the conveyer belt 18. As described above, all the four cartridges P are released from the pressing force, and the operation of separating the photosensitive drum 1*a* from the conveyer belt 18 is completed. As a result, as illustrated in FIG. 11, the tray 26 may be moved to a position capable of being pulled out from the opening portion 91 to the outside position O2. According to the above-mentioned embodiment, in association with the movement of the door (the second openable and closable member) 94 toward the opening direction for opening the opening portion (the second opening portion) 91, the tray 26 is raised. Further, in association with the movement of the door 94 toward the closing direction for closing the opening portion 91, the tray 26 is lowered. Then, the cartridges P supported by the tray 26 are positioned at the image formation position.

Figure 14A:
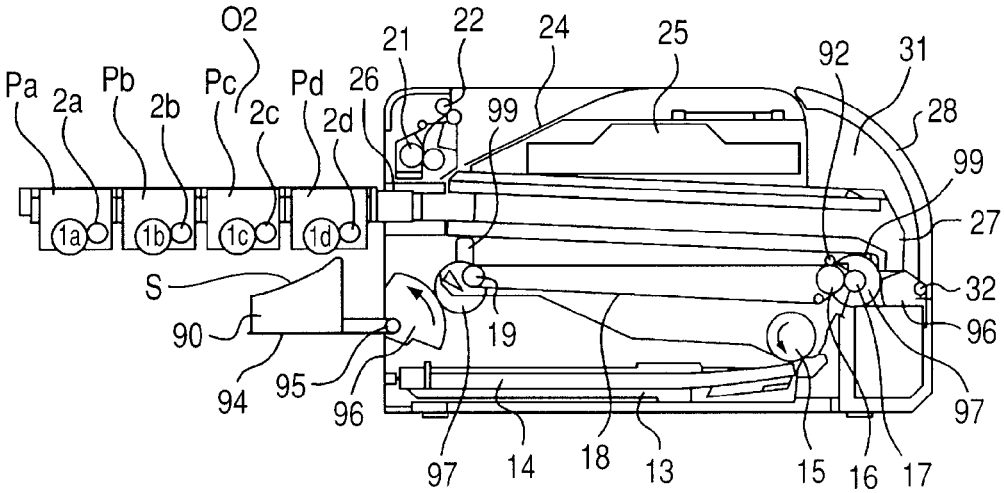
FIGS. 14A and 14B are diagrams illustrating replacement of the cartridges from a rear-side opening portion according to the second embodiment of the present invention.
Figure 14B:
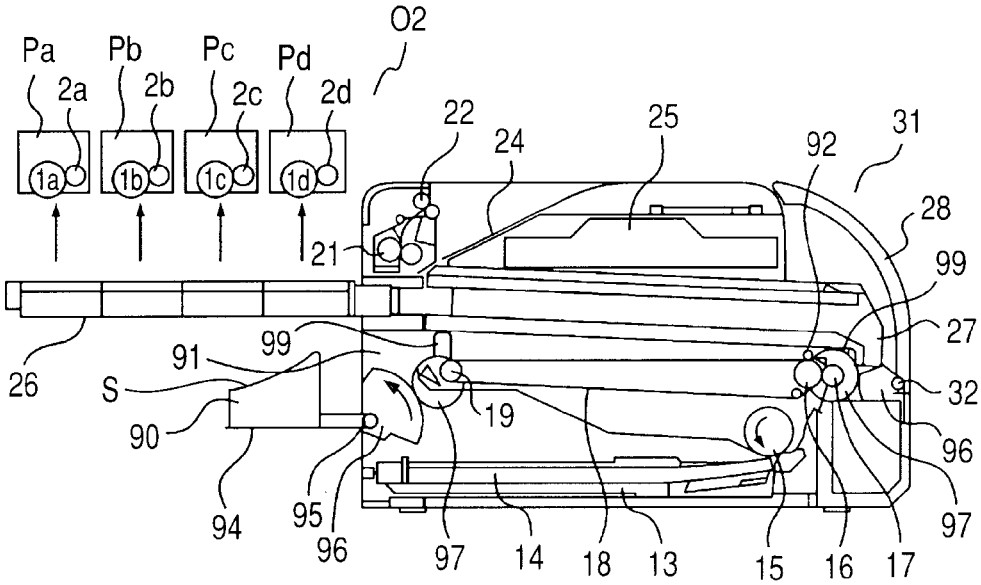

Further, as illustrated in FIG. 14A, the user pulls out the tray 26 obliquely upward (to the outside position O2) from the inside (the inside position I) of the apparatus main body 100*a*. With this operation, the upper surfaces of the cartridges P are opened, and the respective cartridges P become available to be removed as illustrated in FIG. 14B.

Accordingly, when the door 94 is opened to pull out the tray 26 from the opening portion 91 to the outside position O2, it is unnecessary to raise the tray 26 upward by opening the door 28 as in the first embodiment.

Accordingly, for example, when the jamming of the recording medium 14 occurred at the nip portion "n", the door 94 is opened and the tray 26 is pulled out toward the rear side of the apparatus main body as illustrated in FIG. 14A. After that, when the door 28 is opened, the nip portion "n" has already been exposed, with the result that the jam clearance may easily be performed from the opening portion 31.

Figure 15A:
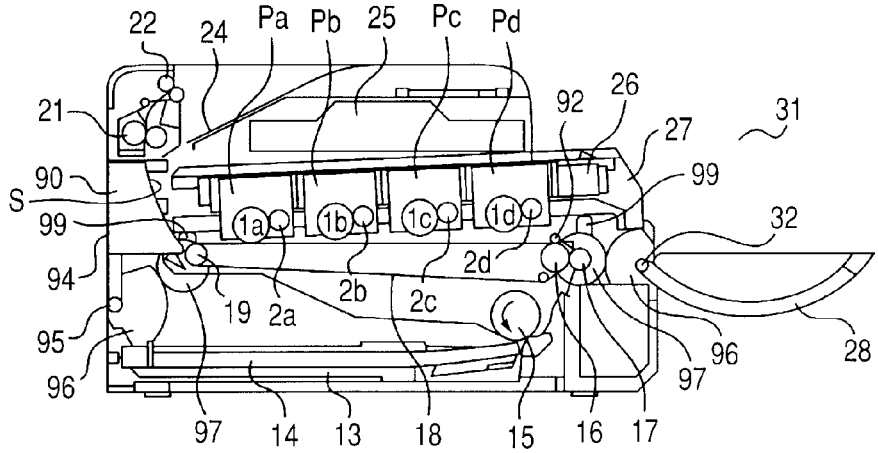
FIGS. 15A, 15B, and 15C are diagrams illustrating replacement of the cartridges from a front-side opening portion according to the second embodiment of the present invention.
Figure 15B:
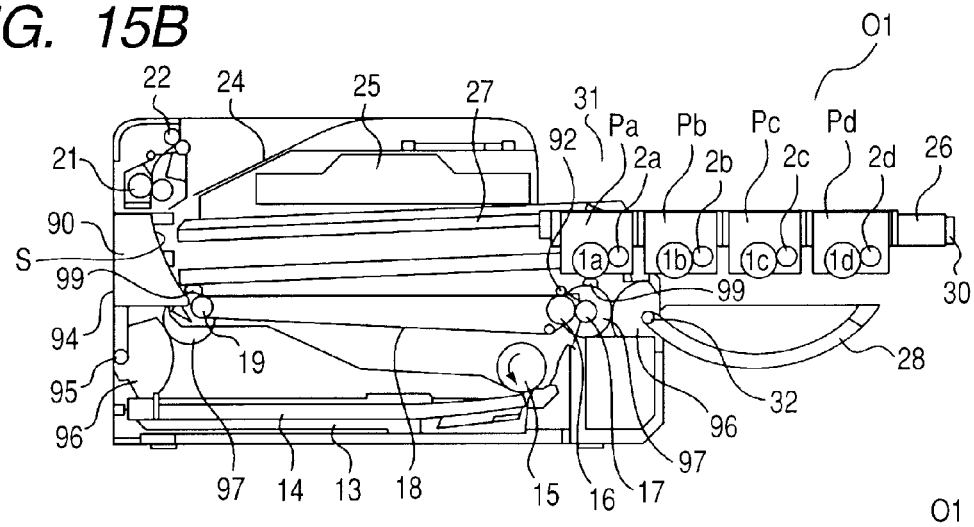
Figure 15C:
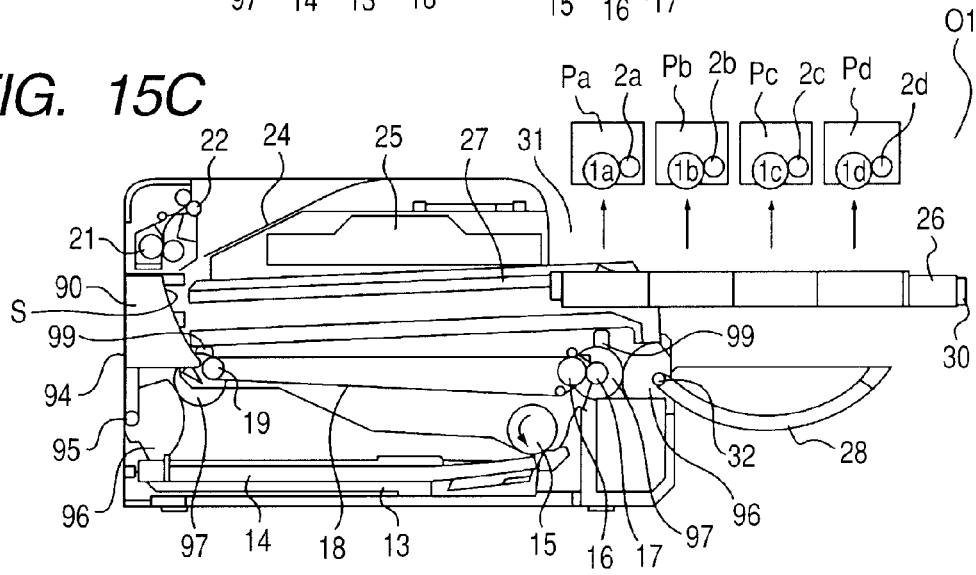

Further, in this embodiment, the door 28 is also provided with a link mechanism including, which is similar to that of the door 94, a gear 96, a gear 97, and a rod 99 as illustrated in FIGS. 12A and 12B. As a result, as illustrated in FIGS. 15A, 15B, and 15C, the cartridges P may be replaced by opening the door 28, and by pulling out the tray 26 obliquely upward from the opening portion 31. Specifically, the raising and lowering of the tray 26 and the pull-out operation of the tray 26 may be carried out independently from any of the front door 28 and the rear side door 94 of the apparatus main body 100*a*.

Further, at this time, even in a case where the user simultaneously opens the door 28 and the door 94, both right and left sides of the tray holding members 27 are raised at the same time, to thereby maintain the horizontally held state. Even in such a state, the tray 26 may be moved to a position at which the pull-out replacement is available.

According to the above-mentioned respective embodiments, the tray (the cartridge supporting member) 26 moves between, while supporting the cartridges P, the inside position I positioned inside the apparatus main body and either the first outside position O1 positioned outside the apparatus main body 100*a* or the second outside position O2 positioned in a different direction of the first outside position O1.

Under this state, the tray 26 may arbitrarily be pulled out from both sides in the fore-and-aft direction of the apparatus main body, and the enhancement of convenience at the time of replacement of the cartridges P may be attained.

Further, in this embodiment, too, as in the first embodiment, for example, three cartridges are made available to be removed from the opening portion on one side, and for example, one cartridge is made available to be removed from the opening portion on the other side. With this structure, the selectivity of the installation space of the apparatus is enhanced.

Figure 16A:
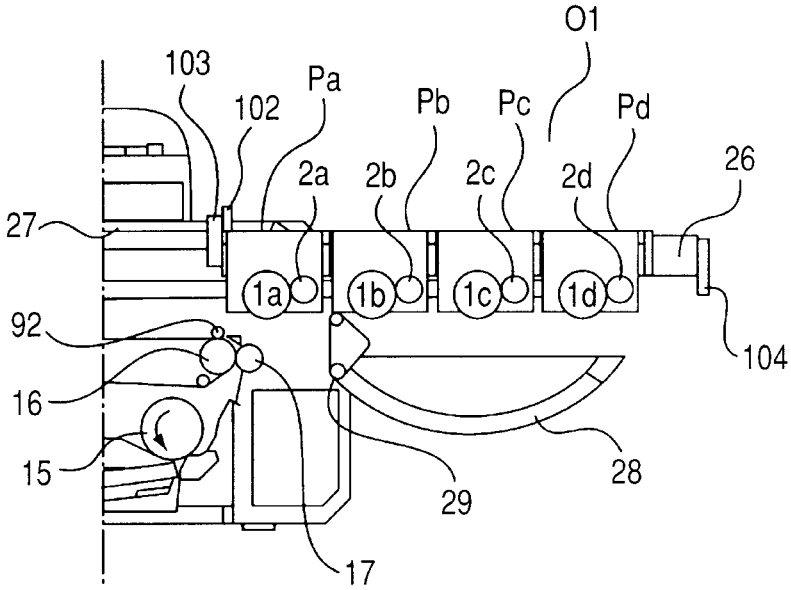
FIGS. 16A and 16B diagrams illustrating a come-off prevention structure of the cartridge tray according to the first and second embodiments of the present invention.
Figure 16B:
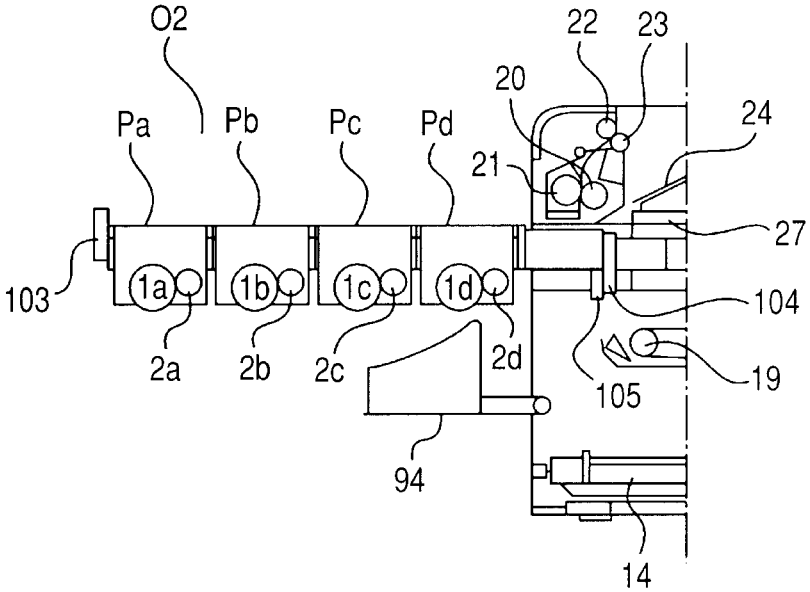

Note that, next, a description will be provided of a come-off prevention structure of the tray 26 according to the first and second embodiments of the present invention with reference to FIGS. 16A and 16B. Tray stoppers (cartridge supporting member regulating portions) 102 and 105 are provide, respectively, on the tray holding members 27 provided in the right and left insides of the main body 100*a*. The stopper (a first cartridge supporting member regulating portion) 102 is provided and fixed on the upper side of the tray holding members 27 on the side at which the door 28 is provided (FIG. 16A). The stopper (a second cartridge supporting member regulating portion) 105 is provided and fixed on the lower side of the tray holding members 27 on the side at which the door 94 is provided (FIG. 16B).

Further, a stopper receiving portion (a first regulated portion) 103 is provided and fixed to the upper portion on the back side of the tray 26. Specifically, the receiving portion 103 is provided at the upstream end portion of the tray 26 in the pull-out direction in which the tray 26 is pulled out to the outside position O1, and is projected upward from the tray 26 (FIG. 16A).

Further, the stopper receiving portion (a second regulated portion) 104 is provided and fixed to the lower portion on the front side of the tray 26. Specifically, the receiving portion 104 is provided at the upstream end portion of the tray 26 in the pull-out direction in which the tray 26 is pulled out to the outside position O2, and is projected downward from the tray 26 (FIG. 16B).

Accordingly, as illustrated in FIG. 16A, when the tray 26 is pulled out maximum to the first outside position O1, the receiving portion 103 is brought into contact with the stopper 102. With this structure, the tray 26 is regulated so that the tray 26 is not pulled out more. Accordingly, the tray 26 is prevented from being come off from the main body 100*a*.

Similarly, as illustrated in FIG. 16B, when the tray 26 is pulled out maximum to the second outside position O2, the receiving portion 104 is brought into contact with the stopper 105. With this structure, the tray 26 is regulated so that the tray 26 is not pulled out more. Accordingly, the tray 26 is prevented from being come off from the main body 100*a*.

With the above-mentioned structure, when the tray 26 is pulled out to the outside position O1, the receiving portion 104 and the stopper 105 do not hamper the movement of the tray 26. Further, when the tray 26 is pulled out to the outside position O2, the stopper 102 and the receiving portion 103 do not hamper the movement of the tray 26.

As described above, in order to prevent the tray 26 from coming off from the main body 100*a* when the tray 26 is pulled out to the outside position O1, the stopper 102 is provided downstream of the main body 100*a* in the pull-out direction. Further, the stopper 102 is provided upstream of the tray 26 in the pull out direction. Further, as described above, when the tray 26 is pulled out to the outside position O2, in order to prevent the tray 26 from coming off from the main body 100*a*, there is provided the stopper 105 provided downstream of the main body 100*a* in the pull-out direction. The stopper 105 is provided upstream of the tray 26 in the pull-out direction. With such a structure, the tray 26 is movable between the first outside position O1 and the second outside position O2. Then, when the tray 26 is pulled out to the first outside position O1 and the second outside position O2, the tray 26 cannot come off from the main body 100*a*.

Note that, in the above-mentioned embodiments, a description will be provided of the example in which the opening portions 31 and 91 are provided in the fore-and-aft of the apparatus main body. However, the invention is not limited thereto. For example, there may employ a structure in which on both right and left sides of the apparatus main body 100*a*, the opening portions are provided, and the cartridge tray (the cartridge supporting member) is allowed to slide in the right and left direction of the apparatus main body 100*a*. Note that, the apparatus main body 100*a* refers to the remainder of the image forming apparatus 100 from which the tray 26 and the cartridges P are removed.

According the above-mentioned embodiments, the tray (the cartridge supporting member) 26 supporting the plurality of cartridges is allowed to move between the inside position I and each of the plurality of outside positions positioned in different directions O1 and O2. Further, the jam clearance operability may be enhanced. Further, a degree of freedom of an installation location when installing the color electrophotographic image forming apparatus may be enhanced. Further, the tray 26 supporting the plurality of cartridges is allowed to be pulled out from an arbitrary opening portion of the plurality of opening portions 31 and 91, a degree of freedom of the installation of the image forming apparatus main body may be enhanced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-067339, filed Mar. 19, 2009, and No. 2010-017585, filed Jan. 29, 2010 which are hereby incorporated by reference herein in their entirety.

The invention claimed is:

1. A color electrophotographic image forming apparatus, in which a plurality of cartridges are removably mounted to an apparatus main body to form an image on a recording medium, the color electrophotographic image forming apparatus comprising:

a cartridge supporting member configured to be movable, while supporting the plurality of cartridges, between an inside position positioned inside the apparatus main body and a first outside position positioned outside the apparatus main body, and between the inside position and a second outside position which is positioned in a different direction from the first outside position;

a first opening portion provided in the apparatus main body, the cartridge supporting member being movable through the first opening portion between the inside position and the first outside position;

a second opening portion provided in the apparatus main body, the cartridge supporting member being movable through the second opening portion between the inside position and the second outside position;

a first openable and closable member configured to openably close the first opening portion; and a second openable and closable member configured to openably close the second opening portion, wherein the first opening portion is provided upstream in a movement direction of the cartridge supporting member moving from the first outside position to the inside position with respect to the apparatus main body, and the second opening portion is provided downstream in the movement direction, wherein the first opening portion and the second opening portion are disposed opposite to each other, and wherein when the cartridge supporting member is pushed in from the first opening portion, the cartridge supporting member is projected from the second opening portion.

2. A color electrophotographic image forming apparatus according to claim 1, wherein in association with a movement of the first openable and closable member in an opening direction for opening the first opening portion, the cartridge supporting member is raised, and in association with a movement of the first openable and closable member in a closing direction for closing the first opening portion, the cartridge supporting member is lowered so that the plurality of cartridges supported by the cartridge supporting member are positioned in an image formation position, and wherein in association with a movement of the second openable and closable member in an opening direction for opening the second opening portion, the cartridge supporting member is raised, and in association with a movement of the second openable and closable member in a closing direction for closing the second opening portion, the cartridge supporting member is lowered so that the plurality of cartridges supported by the cartridge supporting member are positioned in the image formation position.

3. A color electrophotographic image forming apparatus according to claim 1, wherein when the second openable and closable member is opened in a state in which the cartridge supporting member is pulled out from the first opening portion, a conveyance path for the recording medium is exposed.

4. A color electrophotographic image forming apparatus according to claim 3, wherein the conveyance path is provided inside the second openable and closable member and the conveyance path is configured to guide the recording medium, on which developer images transferred from photosensitive drums of the plurality of cartridges have been superimposed, to a receiving portion for receiving the recording medium.

5. A color electrophotographic image forming apparatus according to claim 4, further comprising a conveyer belt with which the photosensitive drums of the plurality of cartridges supported by the cartridge supporting member positioned in the inside position are brought into contact, wherein the recording medium is conveyed by the conveyer belt from a side in which the first opening portion is provided to a side in which the second opening portion is provided, so that the developer images are transferred from the photosensitive drums to the recording medium, and the recording medium is conveyed through inside the second openable and closable member to the receiving portion provided outside the apparatus main body.

6. A color electrophotographic image forming apparatus, in which a plurality of cartridges are removably mounted to an apparatus main body to form an image on a recording medium, the color electrophotographic image forming apparatus comprising:

a cartridge supporting member configured to be movable, while supporting the plurality of cartridges, between an inside position positioned inside the apparatus main body and a first outside position positioned outside the apparatus main body, and between the inside position and a second outside position which is positioned in a different direction from the first outside position;

a first opening portion provided in the apparatus main body, the cartridge supporting member being movable through the first opening portion between the inside position and the first outside position;

a second opening portion provided in the apparatus main body, the cartridge supporting member being movable through the second opening portion between the inside position and the second outside position;

a first openable and closable member configured to openably close the first opening portion;

a second openable and closable member configured to openably close the second opening portion;

a first cartridge supporting member regulating portion provided downstream of the apparatus main body in a pull-out direction to the first outside position;

a first regulated portion provided upstream of the cartridge supporting member in the pull-out direction to the first outside position, the first cartridge supporting member regulating portion and the first regulated portion preventing the cartridge supporting member from coming off the apparatus main body when the cartridge supporting member is pulled out to the first outside position;

a second cartridge supporting member regulating portion provided downstream of the apparatus main body in a pull-out direction to the second outside position; and a second regulated portion provided upstream of the cartridge supporting member in the pull-out direction to the second outside position, the second cartridge supporting member regulating portion and the second regulated portion preventing the cartridge supporting member from coming off the apparatus main body when the cartridge supporting member is pulled out to the second outside position.

7. A color electrophotographic image forming apparatus, in which a plurality of cartridges are removably mounted to an apparatus main body to form an image on a recording medium, the color electrophotographic image forming apparatus comprising:

a cartridge supporting member configured to be movable, while supporting the plurality of cartridges, between an inside position positioned inside the apparatus main body and a first outside position positioned outside the apparatus main body, and between the inside position and a second outside position which is positioned across the apparatus main body to be opposite to the first outside position;

a first opening portion provided in the apparatus main body, the cartridge supporting member being movable through the first opening portion between the inside position and the first outside position;

a second opening portion provided in the apparatus main body, the cartridge supporting member being movable through the second opening portion between the inside position and the second outside position;

a first openable and closable member configured to openably close the first opening portion; and a second openable and closable member configured to openably close the second opening portion.

8. A color electrophotographic image forming apparatus according to claim 7, wherein the second opening portion is provided to be opposite to the first opening portion in a movement direction of the cartridge supporting member moving from the first outside position to the inside position with respect to the apparatus main body.

9. A color electrophotographic image forming apparatus according to claim 7, further comprising a conveyer belt provided to be brought into contact with photosensitive drums of the plurality of cartridges supported by the cartridge supporting member inside the apparatus main body and configured to convey the recording medium.

* * * * *